US010583064B1

(12) United States Patent
Chang

(10) Patent No.: US 10,583,064 B1
(45) Date of Patent: Mar. 10, 2020

(54) STAIRWAY DESCENDING ASSISTANCE DEVICE

(71) Applicant: Nathan Kazumi Chang, San Francisco, CA (US)

(72) Inventor: Nathan Kazumi Chang, San Francisco, CA (US)

( * ) Notice: Subject to any disclaimer, the term of this patent is extended or adjusted under 35 U.S.C. 154(b) by 0 days.

(21) Appl. No.: 16/440,992

(22) Filed: Jun. 14, 2019

Related U.S. Application Data

(60) Provisional application No. 62/687,789, filed on Jun. 20, 2018.

(51) Int. Cl.
*A61H 3/00* (2006.01)
*A45B 1/00* (2006.01)

(52) U.S. Cl.
CPC ..... *A61H 3/00* (2013.01); *A45B 1/00* (2013.01); *A61H 2003/001* (2013.01)

(58) Field of Classification Search
CPC ..... A61H 2003/001; A45B 1/00; A45B 2009/002
See application file for complete search history.

(56) References Cited

U.S. PATENT DOCUMENTS 4,253,287 A * 3/1981 Overmoe ..... E04F 11/1863 135/65
4,899,989 A 2/1990 Kitson et al.
5,022,197 A 6/1991 Aragona
5,318,057 A 6/1994 Wallum
7,870,695 B2 1/2011 Manson et al.
8,291,924 B2 10/2012 King et al.
9,133,624 B2 9/2015 Danziger
9,850,665 B2 12/2017 Amos et al.
2006/0242917 A1 11/2006 Usherovich
2006/0243112 A1* 11/2006 Debrunner ..... B66B 9/0846 83/455

FOREIGN PATENT DOCUMENTS

EP 0452017 A1 10/1991
EP 3004485 B1 1/2018
GB 2106790 A 4/1983
(Continued)

OTHER PUBLICATIONS

Claire Ellicott, StairSteady: Teenage girl on stairlift to millions after stumbling on handrail idea for a GCSE project, https://www.dailymail.co.uk/sciencetech/article-1227637/StairSteady-Teenage-girl-stairlift-millions-stumbling-handrail-idea-GCSE-project.html, website updated Nov. 13, 2009, UK, printed from website Dec. 6, 2018.
(Continued)

*Primary Examiner* — Noah Chandler Hawk
(74) *Attorney, Agent, or Firm* — Randall W. C. Chang

(57) ABSTRACT

An apparatus for assisting a user with safer descent of a stairway that has at least one handrail. The apparatus essentially serves as a second handrail which the user can hold onto and depend on to support their weight, while holding onto a handrail while they descend the stairway. The user would use the apparatus in the handrail engaged configuration when descending a stairway, and in the stowed configuration for all other venues. The portability allows the user to bring the apparatus with them everywhere, enabling the user to become comfortable and confident with the apparatus' use.

21 Claims, 18 Drawing Sheets

(56) References Cited

FOREIGN PATENT DOCUMENTS

| | | |
|---|---|---|
| GB | 2440387 A | 1/2008 |
| GB | 2449302 A | 11/2008 |

OTHER PUBLICATIONS

StairAID—The freedom to choose your own home, http://stairaid.com, UK, printed from website Dec. 5, 2018.
Robert Smith, StairWalker 2.0, https://challenges.openideo.com/challenge/fall-prevention/ideas/stairwalker, website updated May 29, 2017, US, printed from website May 27, 2019.
SMOW Design Blog, https://www.smow.com/blog/2017/07/campustour-2017-royal-college-of-art-graduate-show-london-england/, UK, relevant pp. 9-11, printed from website May 27, 2019.
Screenshot of webpage, https://www.rca.ac.uk/students/nathan-chang/, screenshot taken May 27, 2019.
Scan of show postcard handed out at the Royal College of Art graduate exhibition Jun. 24, 2017 to Jul. 2, 2017.
Explanation of Relevance for Particular References.

* cited by examiner

STAIRWAY DESCENDING ASSISTANCE DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

BACKGROUND OF THE INVENTION

1) Field of the Invention

The present invention relates generally to mobility aids. More particularly the present invention relates to a portable walking aid apparatus which can assist the user with safer descent of a stairway.

2) Description of Related Art

Most people think of mobility aids as walking support, but "mobility" is the ability to effectively move around one's surroundings. Given current architecture, the physical ability and confidence to descend stairways is a key component to mobility. A portable walking aid that assists physically impaired people in walking down stairways independently, easily, and safely, would be highly desirable.

Stairways present a particularly difficult task. In order to change heights, stairways require more physical strength and utilize different leg muscles than walking on flat ground. Also, due to the change in levels, balance and coordination are a big part of negotiating steps. To help address the issue with balance, stairways often have handrails to provide support and stability, but for a variety of reasons, many times there is only one handrail available to be used at one time. In an ideal situation, there would be handrails on both sides for a person to hold onto as they descend a stairway. However, many stairways are constructed with a handrail only on one side or are of such width as to make it impossible for the average person to hold onto the handrails on both sides of the stairway as they descend. Conventional canes, crutches, and walkers ("walking aids") are not adapted for use on stairways although they may be quite satisfactory on level surfaces. In order for a walking aid to be useful in descending a stairway, it must be kept at a proper angle to prevent the user from falling forward down the stairway. If the user lacks adequate strength and balance, the walking aid may not provide sufficient support to prevent the user from falling. Even if the user were to hold the handrail with one hand, and a conventional walking aid in the other hand, because of the range of motion possible for a conventional walking aid when the tip of a conventional walking aid is planted on the tread of the next lower step, the user is still at considerable risk of falling down the stairway. FIGS. 1A-1C illustrate this point with XYZ coordinate axis

1 located at the point on a stairway 60 where the conventional walking aid 41 is planted on the tread of the step ("step below") just below the step that the user is standing on, with the $X_1Y_1$ plane being coplanar with the plane of the tread. As can be seen from FIGS. 1A-1C, a conventional walking aid 41 can rotate freely around the $X_1$, $Y_1$, and $Z_1$ axes unless constrained by the user. To avoid the risk of falling forward down a stairway, some people choose to descend a stairway by walking backwards down the stairway. While this reduces certain aspects of risk, walking backwards introduces other aspects of risk. The presence of elevators, escalators, or chair lifts in buildings ("mechanical lifts") could provide an alternative to stairway negotiation, but there are many reasons (e.g. cost, structural limitations, space limitations) which may preclude installation of mechanical lifts.

Not only are stairways more dangerous than walking on level ground, the consequences from a fall are much greater. In these cases, people fall from greater heights and can continue falling until they reach the bottom of the stairways or contact another obstacle to stop their fall, extending the opportunity for them to be hurt during the fall. For the elderly or those with physical injury, such a fall might be difficult if not impossible to recover from. A fall might exacerbate existing injuries or lead to serious injuries like broken bones, concussions, or even death. For the elderly, complete recovery from a fall may not occur. These falls do not only cause physical damages, but also psychological. Coming back after a fall, one might be more wary of stairways and avoid places or just not take the chance at all and stop going about.

The danger of physical injury and the lack of confidence can lead to a more restricted or sedentary lifestyle which can prevent one from reaping the exercise benefits of an active lifestyle. Muscle atrophy may accelerate once a person stops taking the stairways, increasing the likelihood of that person no longer being able to negotiate stairways safely anymore. Also, by restricting the places one might go in an effort to avoid stairways, a person's independence is compromised and quality of life could decrease since they could no longer go where they would like.

Mobility aids that are directed for assistance with stairs can mainly be grouped into two types: 1) support bars installed with custom handrails in a building; 2) modified walking aids.

Some of the drawbacks and limitations to custom installed support bars are: a) they are costly compared to walking aids, and involve building modification/installation; b) the support bars do not work with walking aids, requiring a user to carry a walking aid while descending a stairway, or keep a mobility aid on each floor; c) the support bars do not serve as walking aids once the user has descended the stairway, requiring a user to carry a walking aid while descending a stairway, or keep a mobility aid on each floor; d) while support bars may be useful in a home or other building, their usefulness is limited to that installation. In certain cases, this could be counterproductive because a person might feel less confident in situations where support bars are not available. Issued U.S. Pat. No. 9,850,665 discloses a stair assistance device for use with a handrail.

A significant drawback and limitation to modified walking aids is that they aim to assist the user on stairways in a similar manner as walking on level ground. As discussed previously, descending a stairway requires a different level of strength and balance than walking on level ground. Issued U.S. Pat. No. 8,291,924 discloses a multi-configuration walking apparatus.

BRIEF SUMMARY OF THE INVENTION

An object of the present invention is to provide a portable walking aid apparatus to assist a user with safer descent of a stairway that has at least one handrail. Another object of the present invention is to provide an apparatus that essentially serves as a "second handrail" which the user can hold onto and depend on to support their weight, while holding onto a handrail while they descend a stairway. For persons with limited mobility, it is generally recommended that they lower one foot (usually the weaker foot) to the step below, followed by the other foot landing on the same step. A further object of the present invention is to provide the user the ability to descend a stairway one step at a time, while limiting how far forward the user can lean, greatly reducing the likelihood of falling forward down the stairway. A further object of the present invention is to provide the user with an apparatus that is portable, and usable in two configurations: a stowed configuration and a handrail engaged configuration. The user would use the apparatus in the handrail engaged configuration when descending a stairway, and in the stowed configuration for all other venues. The portability allows the user to bring the apparatus with them everywhere, enabling the user to become comfortable and confident with the apparatus' use.

FIG. 2 illustrates various embodiments of the present invention, showing a perspective view of apparatus 1 in handrail engaged configuration engaged with handrail 50 and disposed on the tread of a step on stairway 60. Referring to FIG. 3, in various embodiments of the present invention ("embodiments") apparatus 1 comprises: a weight support assembly 100, a connecting assembly 200 attached to the weight support assembly 100, and a handrail anchoring assembly 300 attached to the connecting assembly 200.

Apparatus 1 has stowed and handrail engaged configurations. In the stowed configuration, the connecting assembly 200 and handrail anchoring assembly 300 would be stowed, allowing the weight support assembly 100 to be utilized by the user in customary venues, except when descending stairways. For descending stairways, the apparatus would be used in the handrail engaged configuration. In this configuration, the connecting assembly 200 would extend out from the weight support assembly, and the handrail anchoring assembly 300 would engage with the handrail 50. In various embodiments, in the stowed configuration, the connecting assembly 200 and handrail anchoring assembly 300 are external to and preferably stowed in a position generally parallel to the weight support assembly 100. In other various embodiments, in the stowed configuration, the connecting assembly 200 and the handrail anchoring assembly 300 are stowed internal to the weight support assembly 100.

FIGS. 4A-4E illustrate various embodiments of the present invention, providing different views of a user utilizing apparatus 1 in handrail engaged configuration with handrail 50 to descend stairway 60. In the handrail engaged configuration, the connecting assembly 200 stabilizes the weight support assembly 100 so that the weight support assembly 100 is limited in its range of motion, limiting how far forward the user could lean and possibly fall. Referring to FIGS. 4A-4E, XYZ coordinate axis 1 is located at the point where the weight support assembly 100 end is planted on the tread of the step below, and the $X_1Y_1$ plane is co-planar with the plane of the tread. As can be seen from FIGS. 4A-4E, the weight support assembly 100 is constrained from rotating freely around the $Y_1$ and $Z_1$ axes.

Referring to FIGS. 4A-4E and 5A-5H, XYZ coordinate axis 2 is located at the point on the handrail 50 where the handrail anchoring assembly 300 contacts the upper surface of handrail 50. Crossbar member 9 of the connecting assembly 200 and the handrail 50 ($Y_2$ axis) form an angle $\alpha$ ("anchor engaging angle") therebetween. Referring to FIGS. 5A-5B, when the anchor engaging angle is less than or equal to an anchor locking angle (shown as 90 degrees), the handrail anchoring assembly 300 is resistant to sliding downward along the longitudinal axis ($Y_2$ axis) of the handrail 50. The weight support assembly 100 is resistant to rotating freely around the $X_1$ axis (FIGS. 4A-4E) in the negative direction when the anchor engaging angle is less than or equal to the anchor locking angle. Referring to FIGS. 5C-5E, when the anchor engaging angle (shown as 100 degrees) is less than an anchor release angle but greater than the anchor locking angle, the handrail anchoring assembly 300 is resistant to being disengaged from the handrail 50 but can still freely slide along the longitudinal axis ($Y_2$ axis) of the handrail 50. Referring to FIGS. 5F-5H, when the anchor engaging angle is greater than the anchor release angle (shown as 113 degrees), the handrail anchoring assembly 300 can be placed on ("engaged") the handrail 50 and pulled off ("disengaged") from the handrail 50, and can freely slide along the longitudinal axis ($Y_2$ axis) of the handrail 50. In FIGS. 5A-5H, the anchor engaging angle, anchor locking angle and anchor release angle shown are exemplary. In actual practice, the anchor locking angle and anchor release angle will vary according to the handrail anchoring assembly 300 design and handrail 50 shape and dimensions.

Referring to FIGS. 4A-4E, to descend a stairway 60, the user would engage the handrail anchoring assembly 300 with the handrail 50. Grasping the handrail 50 with the hand ("handrail hand") proximal to the handrail, the user would use their other hand ("handle hand") to grasp weight support assembly 100 to lift and rotate the apparatus 1 in the positive direction around the $Z_2$ axis sufficiently to ensure that the anchor engaging angle is greater than the anchor locking angle but less than the anchor release angle. Maintaining a grasp of the handrail 50 with their handrail hand, the user uses their handle hand to exert a force on weight support assembly 100 so that apparatus 1 translates in the positive $Y_2$ direction until the handrail anchoring assembly 300 (still on the handrail) is located over the step below. The user may use their handrail hand to assist the handrail anchoring assembly 300 in sliding downward along handrail 50 (positive $Y_2$ axis direction). Maintaining their grasp of the handrail 50 with their handrail hand, the user would use their handle hand (still grasping weight support assembly 100) to rotate the apparatus 1 in the negative direction around the $Z_2$ axis sufficiently to ensure that the anchor engaging angle is less than or equal to the anchor locking angle. This is to provide resistance for the handrail anchor assembly 300 disengaging from the handrail 50, sliding further downward along the longitudinal axis of the handrail 50, or the apparatus 1 rotating in the negative $Z_2$ axis direction while the user is stepping down to the step below. The user would then plant the weight support assembly 100 on the tread of the step below. The user steps down to the step below, grasping weight support assembly 100 with their handle hand for weight support and continuing to grasp the handrail 50 with their handrail hand. In stepping down to the step below, the user relies upon the weight support assembly 100 to help support their weight and for stability, while grasping the handrail 50 for balance and support. When the user is ready to step down to the next step below, the user would repeat the process.

BRIEF DESCRIPTION OF THE SEVERAL VIEWS OF THE DRAWING

In the figures, like or similar elements (such as handle 15) utilize the same reference characters throughout the various views.

DETAILED DESCRIPTION OF THE INVENTION

Figure 1A:
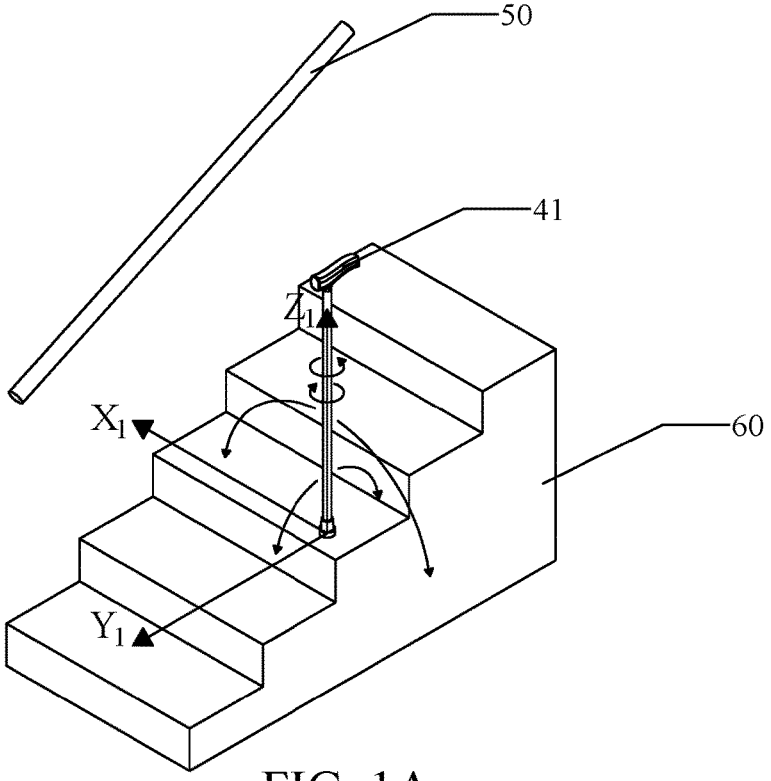
FIGS. 1A-1C illustrate an XYZ coordinate axis 1 located at the point where a conventional walking aid is planted on the tread of a step, with the $X_1Y_1$ plane being coplanar with the plane of the tread.
Figure 1B:
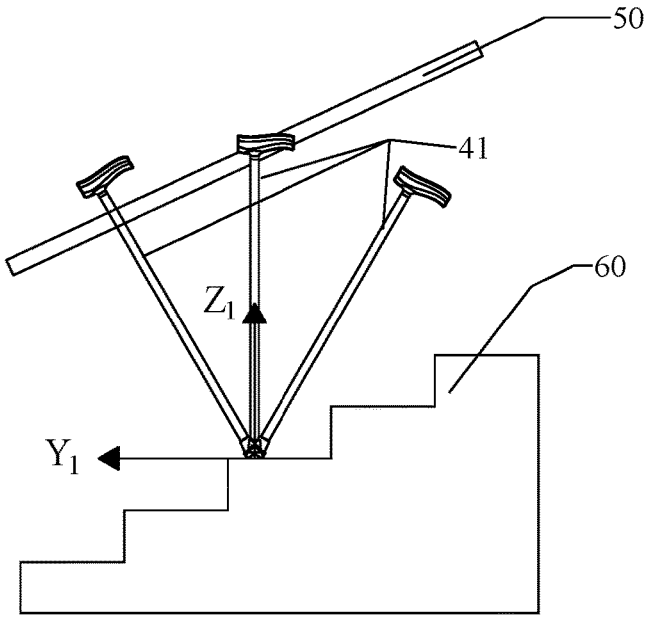
Figure 1C:
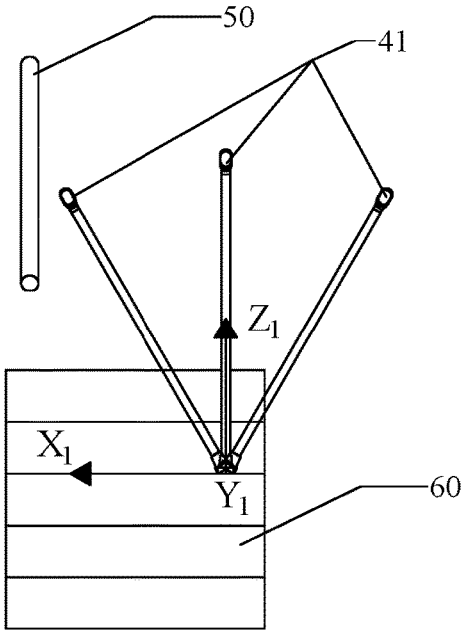
Figure 2:
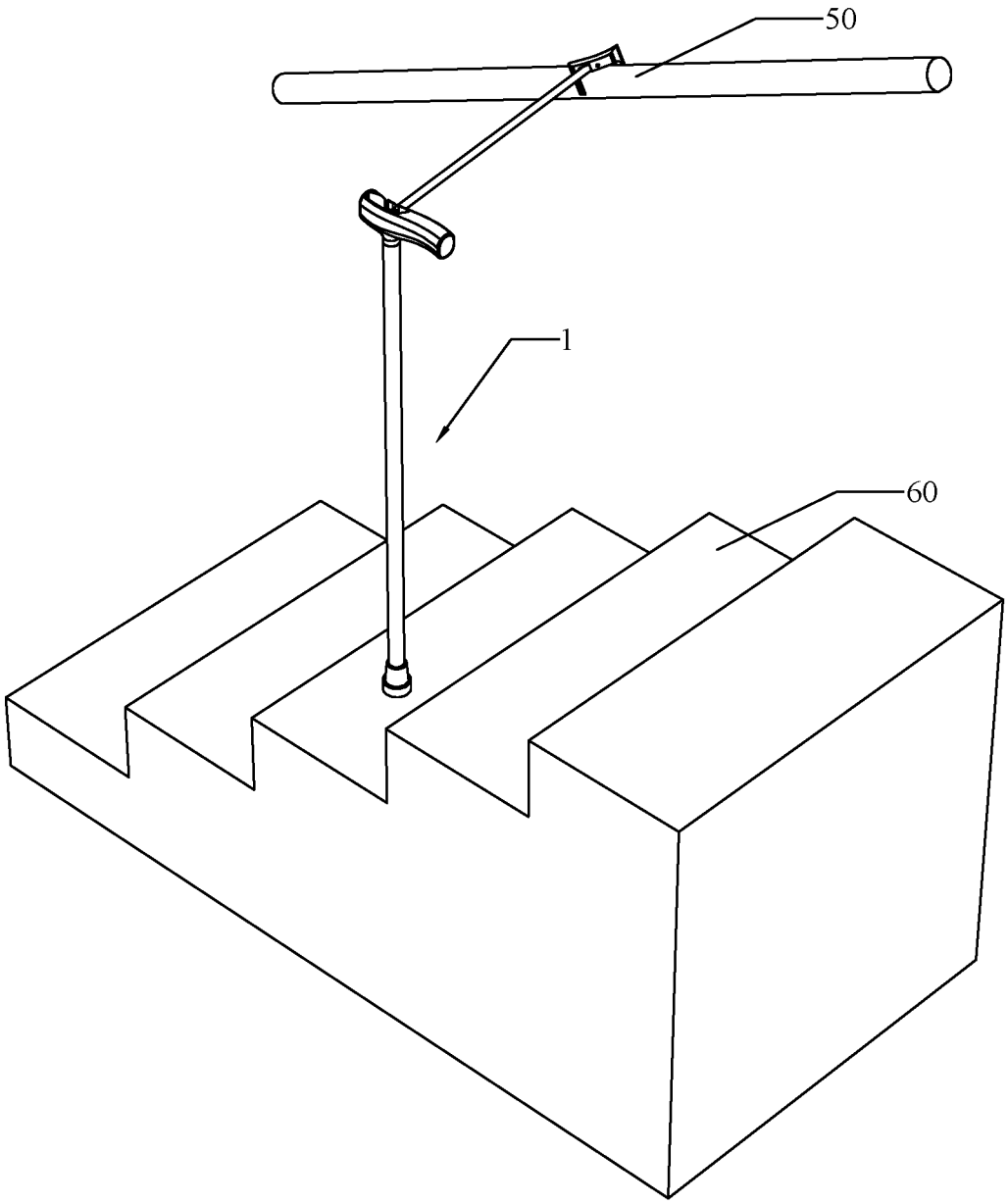
FIG. 2 illustrates various embodiments of the present invention, showing a perspective view of apparatus 1 in handrail engaged configuration engaged with handrail 50 and disposed on the tread of a step on stairway 60.
Figure 3:
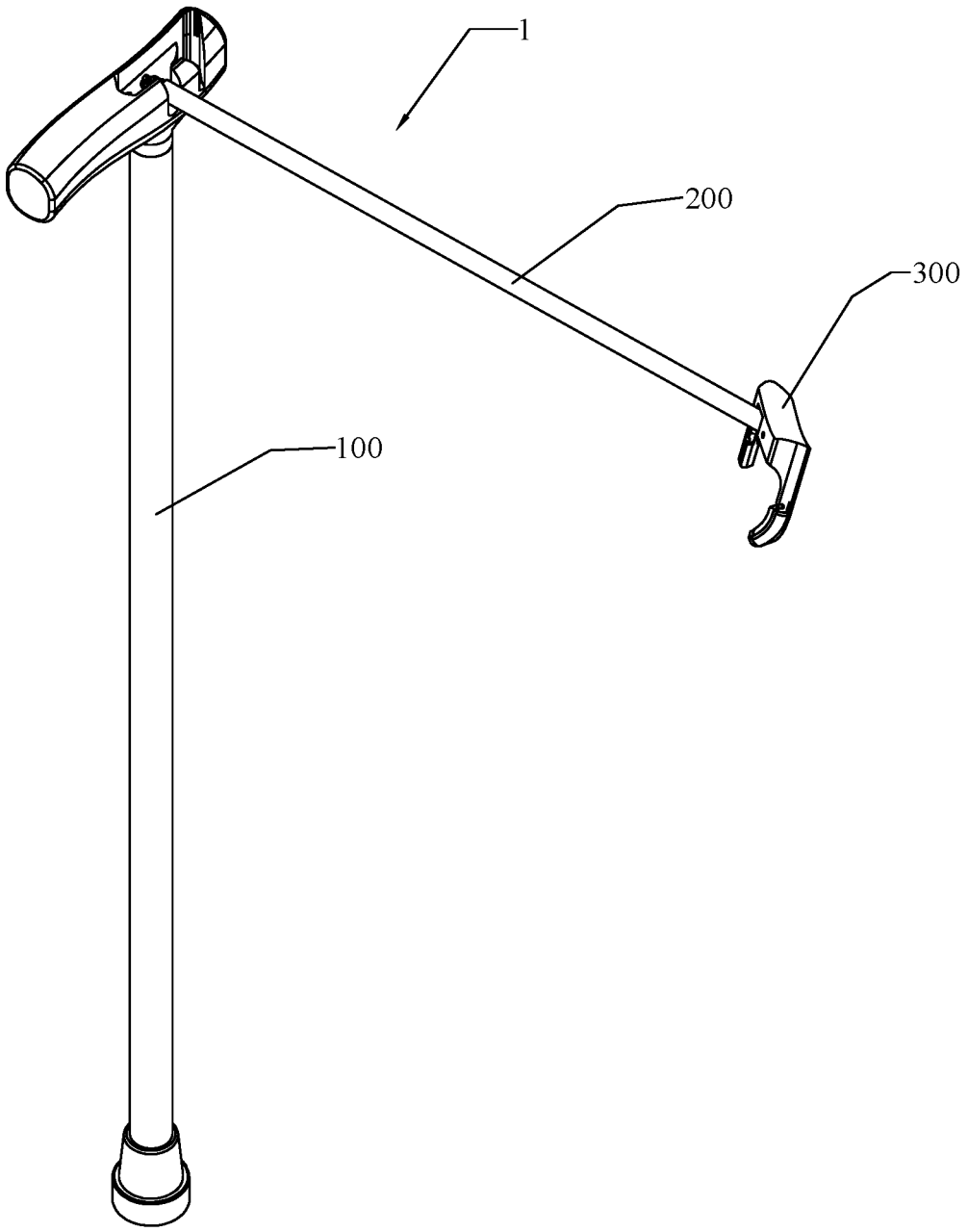
FIG. 3 illustrates various embodiments of the present invention, providing a perspective view of apparatus 1 illustrating weight support assembly 100, connecting assembly 200, and handrail anchoring assembly 300.
Figure 4A:
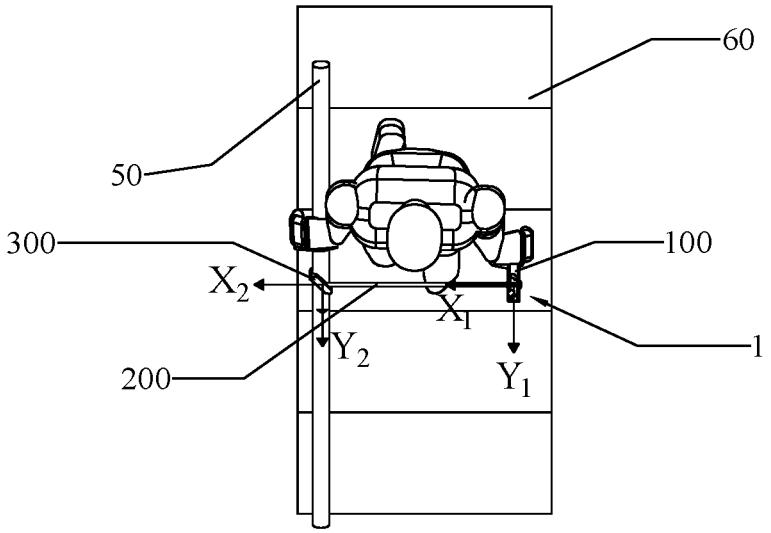
FIGS. 4A-4E illustrate various embodiments of the present invention, providing different views of a user utilizing apparatus 1 in handrail engaged configuration with handrail 50 to descend stairway 60.
Figure 4B:
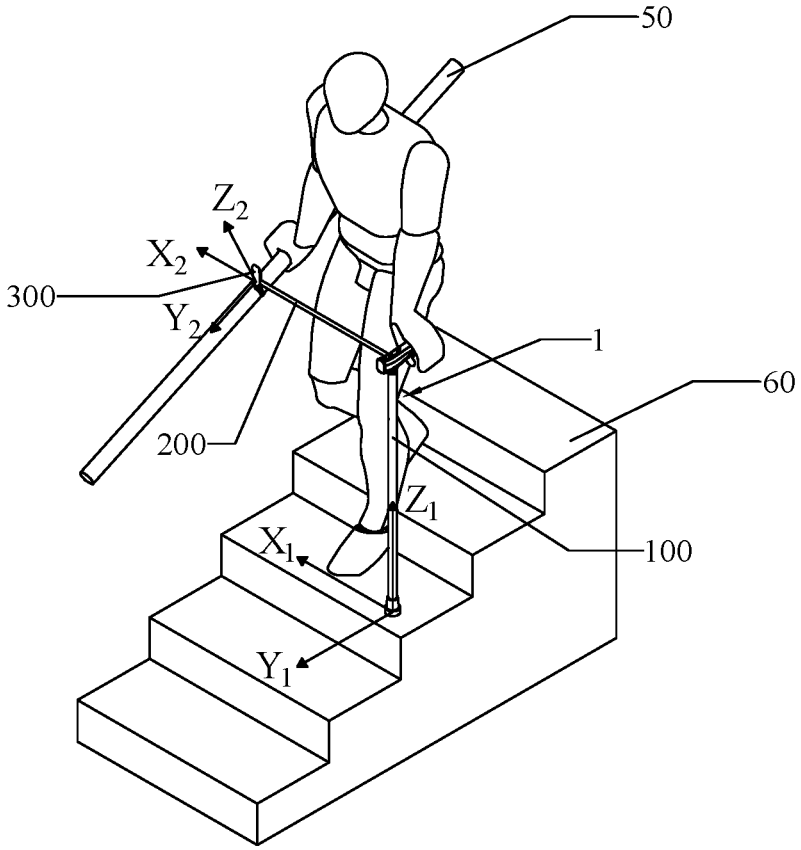
Figure 4C:
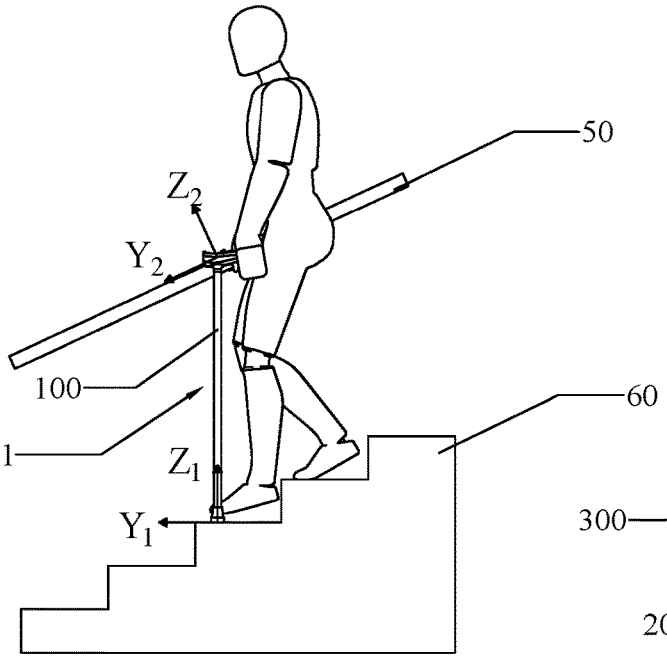
Figure 4D:
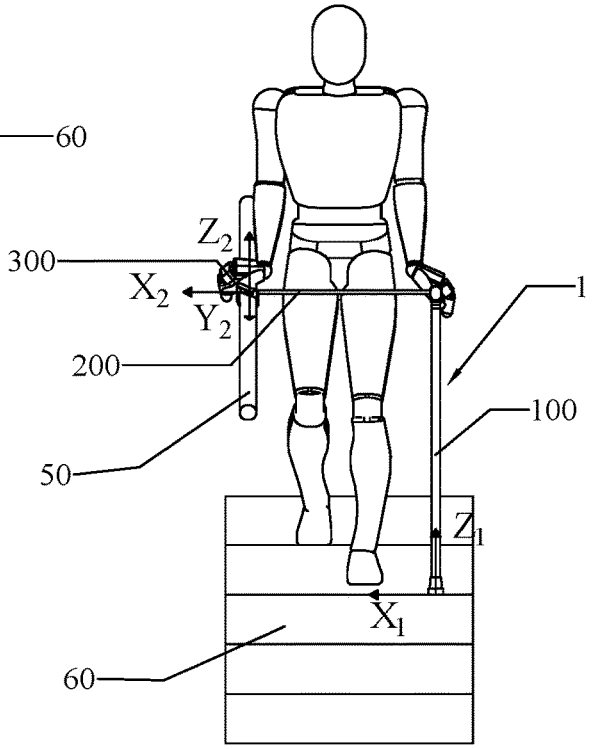
Figure 4E:
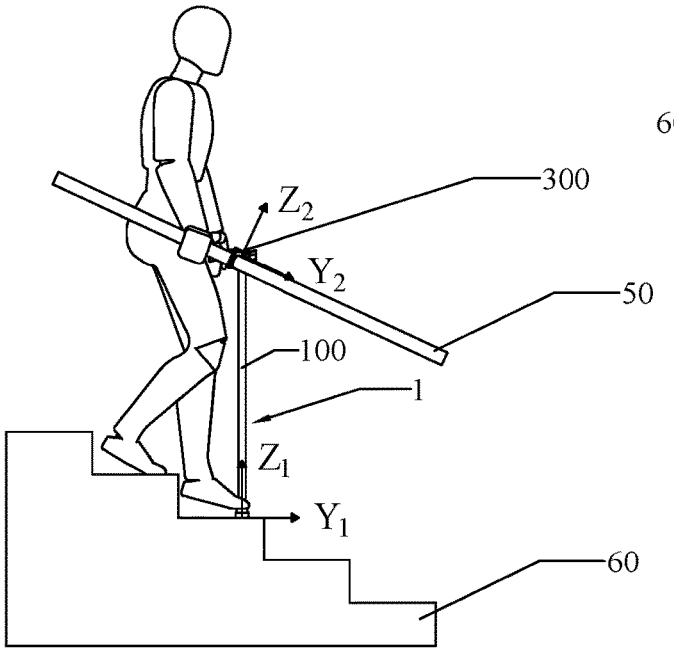

FIG. 2 illustrates various embodiments of the present invention, showing a perspective view of apparatus 1 in handrail engaged configuration engaged with handrail 50 and disposed on the tread of a step on stairway 60. Referring to FIG. 3, in various embodiments of the present invention ("embodiments") apparatus 1 comprises: a weight support assembly 100, a connecting assembly 200 attached to the weight support assembly 100, and a handrail anchoring assembly 300 attached to the connecting assembly 200.

Apparatus 1 has stowed and handrail engaged configurations. In the stowed configuration, the connecting assembly 200 and handrail anchoring assembly 300 would be stowed, allowing the weight support assembly 100 to be utilized by the user in customary venues, except when descending stairways. For descending stairways, the apparatus would be used in the handrail engaged configuration. In this configuration, the connecting assembly 200 would extend out from the weight support assembly 100, and the handrail anchoring assembly 300 would engage with the handrail. In various embodiments, in the stowed configuration, the connecting assembly 200 and handrail anchoring assembly 300 are external to and preferably stowed in a position generally parallel to the weight support assembly 100. In other various embodiments, in the stowed configuration, the connecting assembly 200 and the handrail anchoring assembly 300 are stowed internal to the weight support assembly 100.

FIGS. 4A-4E illustrate various embodiments of the present invention, providing different views of a user utilizing apparatus 1 in handrail engaged configuration with handrail 50 to descend stairway 60. In the handrail engaged configuration, the connecting assembly 200 stabilizes the weight support assembly 100 so that the vertical support member 100 is limited in its range of motion, limiting how far forward the user could lean and possibly fall. Referring to FIGS. 4A-4E, XYZ coordinate axis 1 is located at the point where the weight support assembly 100 end is planted on the tread of the step below, and the $X_1Y_1$ plane is co-planar with the plane of the tread. As can be seen from FIGS. 4A-4E, the weight support assembly 100 is constrained from rotating freely around the $Y_1$ and $Z_1$ axes.

Figure 5A:
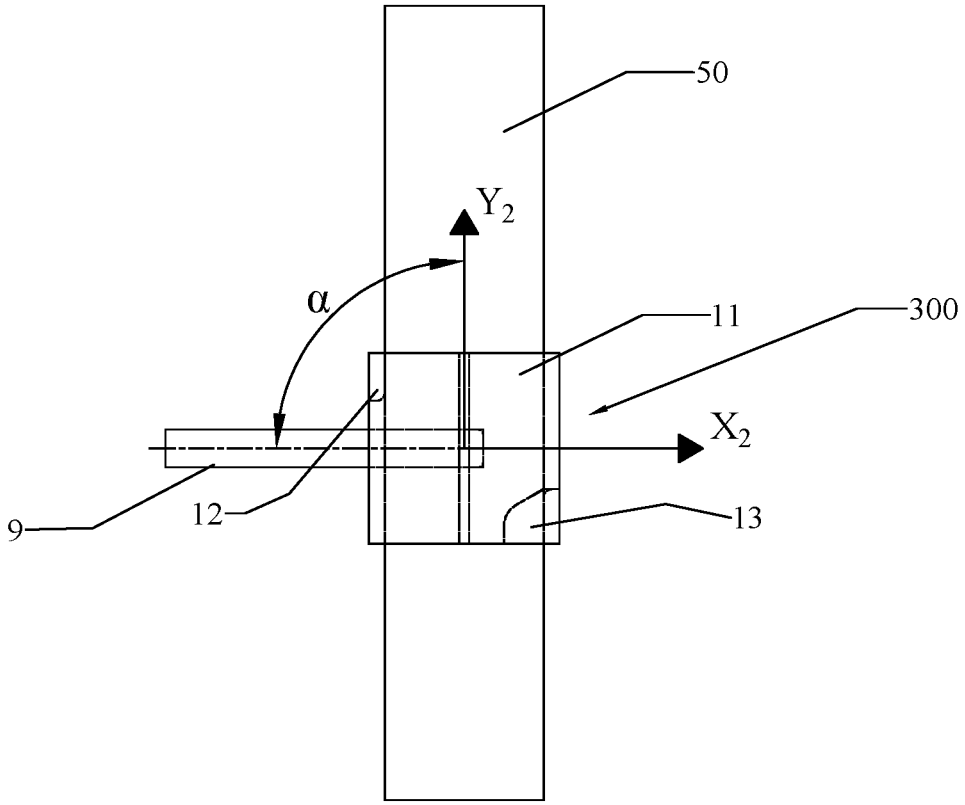
FIGS. 5A-5H illustrate various embodiments of the present invention, providing views of handrail anchoring assembly 300 engaged with handrail 50 at different anchor engaging angles with respect to XYZ coordinate axis 2.
Figure 5B:
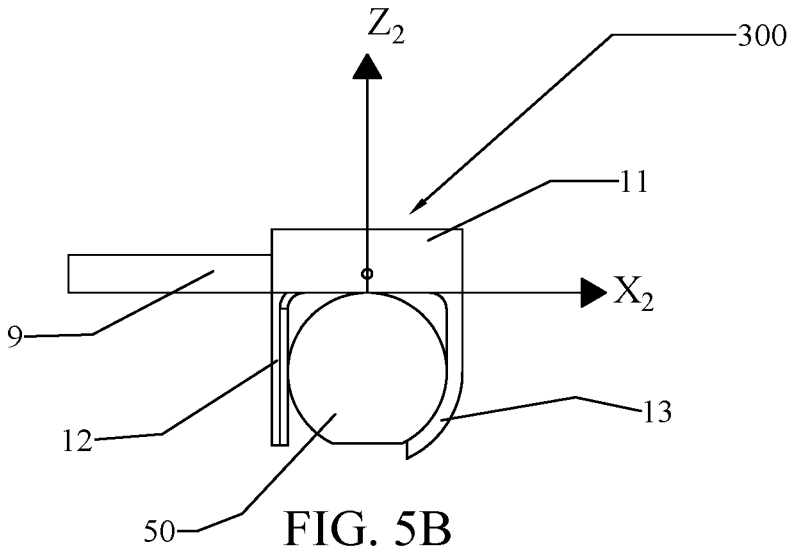
Figure 5C:
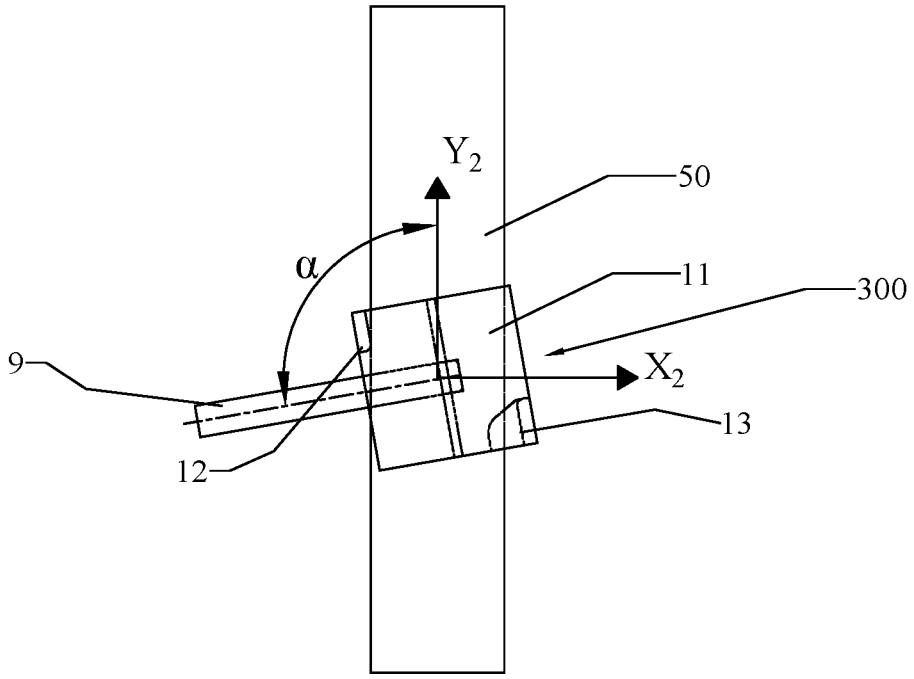
Figure 5D:
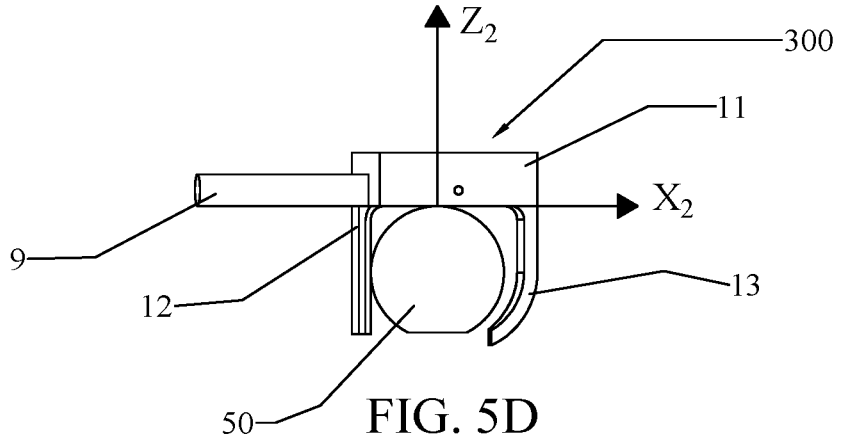
Figure 5E:
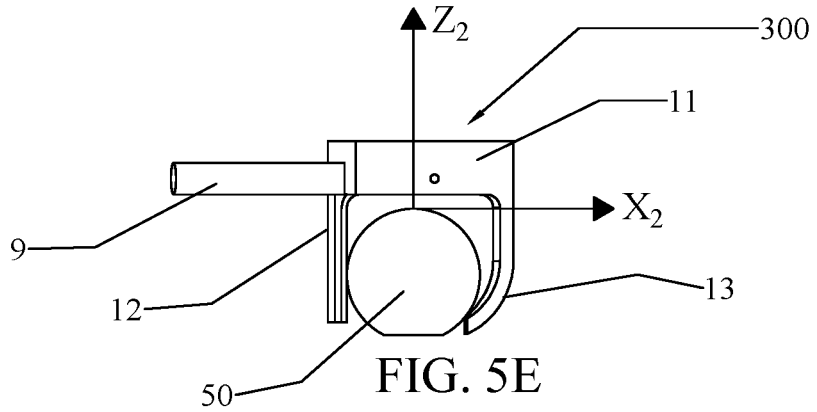
Figure 5F:
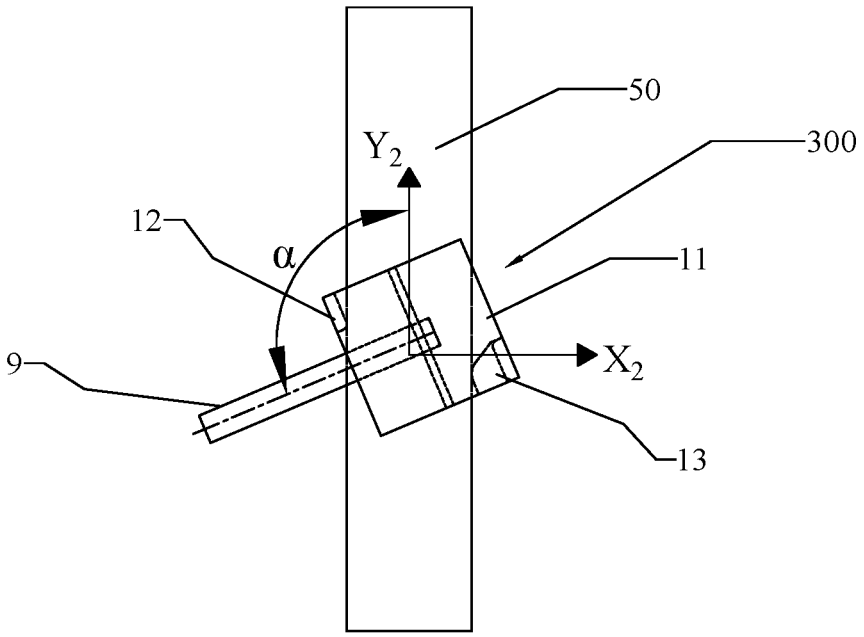
Figure 5G:
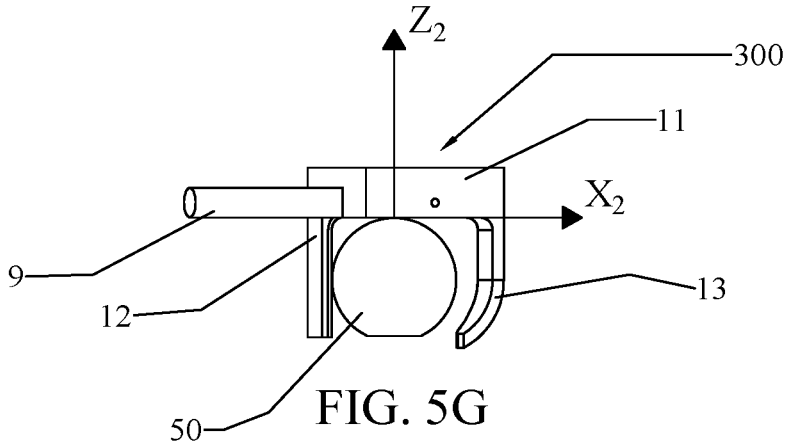
Figure 5H:
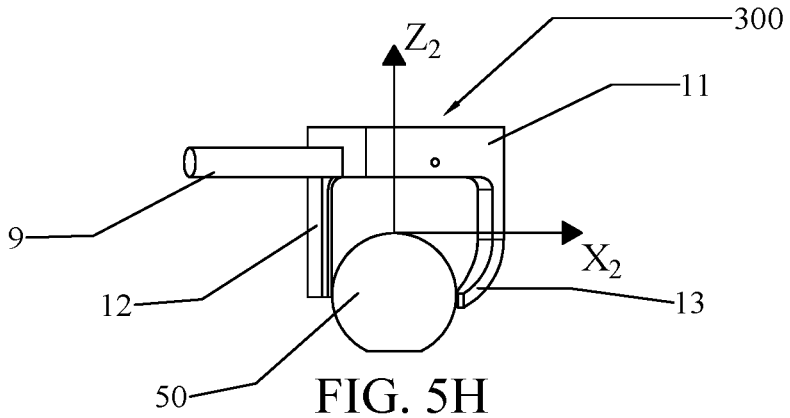

Referring to FIGS. 4A-4E and 5A-5H, the handrail 50 has an upper surface, a lower surface, a surface proximal to the user ("proximal surface"), and a surface distal to the user ("distal surface"), with the XYZ coordinate axis 2 located at the point on the handrail 50 where the handrail anchoring assembly 300 contacts the upper surface of handrail 50. Crossbar member 9 of the connecting assembly 200 and the handrail 50 ($Y_2$ axis) form an angle $\alpha$ ("anchor engaging angle") therebetween. Referring to FIGS. 5A-5B, when the anchor engaging angle is less than or equal to an anchor locking angle (shown as 90 degrees), the handrail anchoring assembly 300 is resistant to sliding downward along the longitudinal axis ($Y_2$ axis) of the handrail 50, and the apparatus 1 rotating in the negative $Z_2$ axis direction. The weight support assembly 100 is resistant to rotating freely around the $X_1$ axis (FIGS. 4A-4E) in the negative direction when the anchor engaging angle is less than or equal to the anchor locking angle. Referring to FIGS. 5C-5E, when the anchor engaging angle (shown as 100 degrees) is less than an anchor release angle but greater than the anchor locking angle, the handrail anchoring assembly 300 is resistant to being disengaged from the handrail 50 in the $Z_2$ direction but can still freely slide along the longitudinal axis of the handrail 50. Referring to FIGS. 5F-5H, when the anchor engaging angle is greater than the anchor release angle (shown as 113 degrees), the handrail anchoring assembly 300 can be placed on ("engaged") the handrail 50 and pulled off ("disengaged") from the handrail 50, and can freely slide along the longitudinal axis ($Y_2$ axis) of the handrail 50. In FIGS. 5A-5H, the anchor engaging angle, anchor locking angle and anchor release angle shown are exemplary. In actual practice, the anchor locking angle and anchor release angle will vary according to the handrail anchoring assembly 300 design and the particular handrail 50 shape and dimensions that it engages with.

Figure 6:
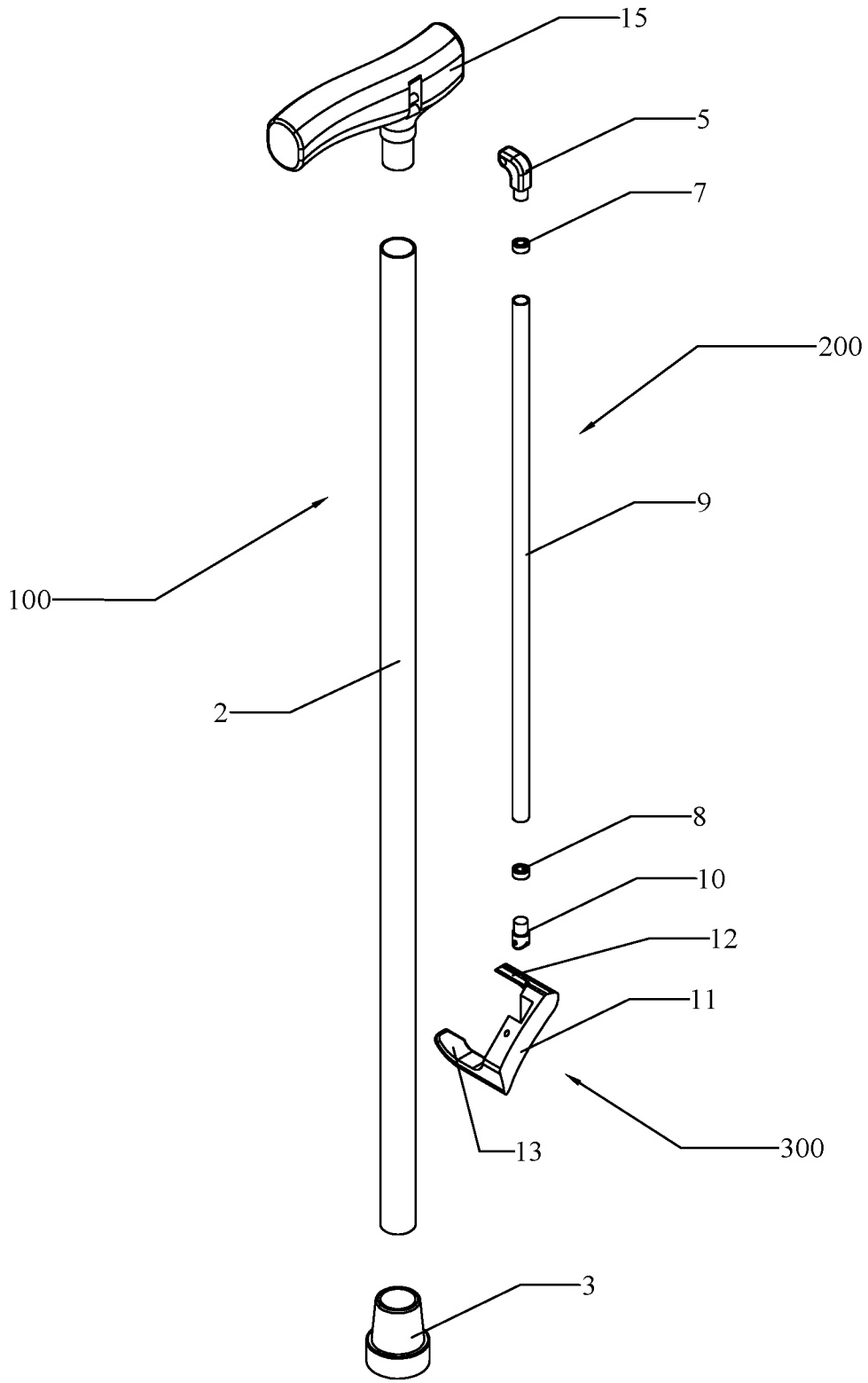
FIG. 6 illustrates various embodiments of the present invention, providing a perspective exploded view of an embodiment where the connecting assembly 200 and handrail anchoring assembly 300 are stowed external to the weight support assembly 100.

Referring to FIG. 6, in certain embodiments of the present invention, the weight support assembly 100 comprises: a handle 15, a portion of which is grasped by the handle hand of the user; a weight support member 2 having one end connected to the handle 15 and another end intended to be placed on the tread of each step below of a stairway 60 as the user descends the stairway. In further embodiments, weight support assembly 100 further comprises cap 3, preferably composed of a resilient non-skid material, such as rubber.

Figure 7A:
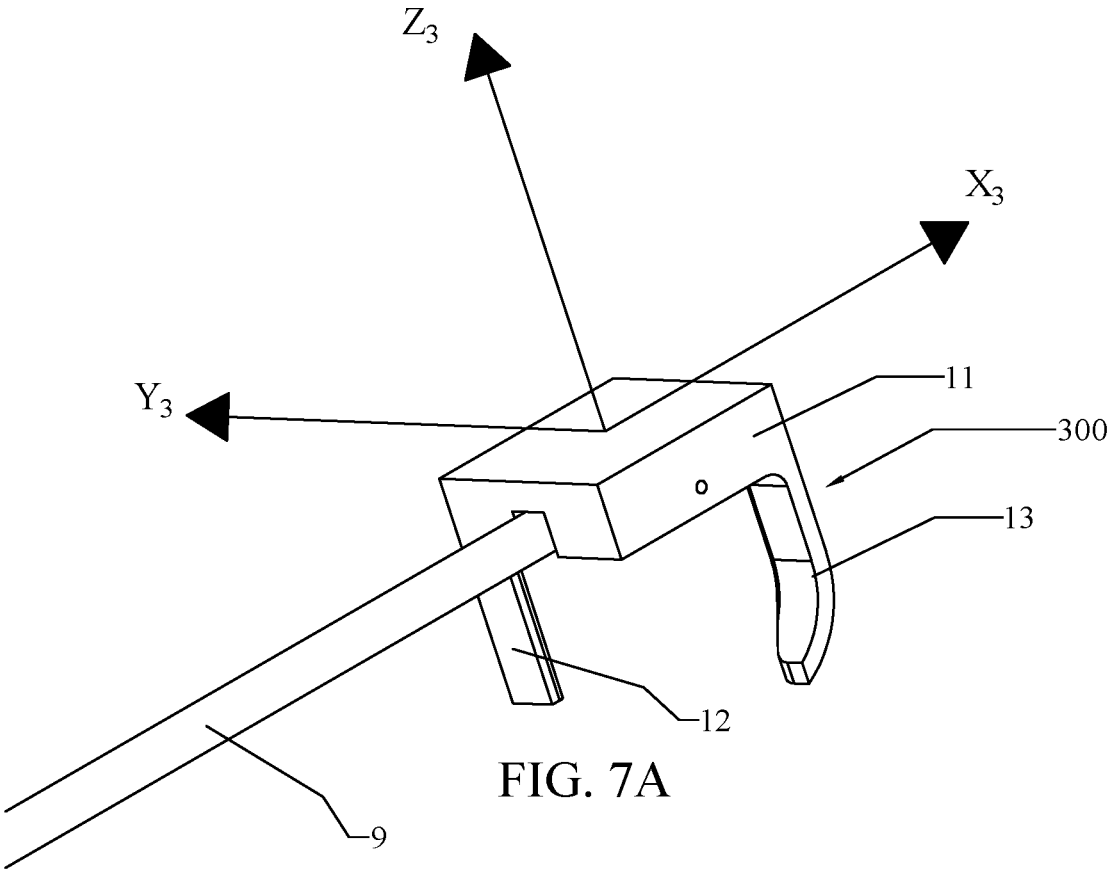
FIGS. 7A-7B illustrate various embodiments of the present invention, showing location of XYZ coordinate axis 3.

Referring to FIG. 7A, XYZ coordinate axis 3 is located on the upper surface of anchor body 11. Referring to FIGS. 5A-5H and 7A, the handrail anchoring assembly 300 comprises: an anchor body 11 having a lower surface, an end proximal to said user ("proximal end") and an end distal to said user ("distal end"); an inner arm 12 projecting downward (negative $Z_3$ axis direction) from said anchor body 11 lower surface at said anchor body 11 proximal end, having a generally flat shape, and having a length preferably equal to the thickness of said handrail 50; and an outer arm 13 projecting downward (negative $Z_3$ axis direction) from said anchor body 11 lower surface at said anchor body 11 distal end, having a generally concave shape, and having a length preferably equal to the thickness ($Z_2$ axis dimension) of said handrail 50. Said inner arm 12 and outer arm 13 have opposing inner surfaces and said inner arm 12 is located forward of said outer arm 13 with respect to axis $Y_3$. In further embodiments, pads of resilient non-skid material (such as rubber) are placed only on the inner surface of outer arm 13, only on the inner surface of inner arm 12, or on both the inner surfaces of outer arm 13 and inner arm 12. Design consideration parameters would include: the anchor body 11 dimensions ($X_3$,$Y_3$,$Z_3$ axes), including the inner arm 12 and outer arm 13 dimensions ($X_3$,$Y_3$,$Z_3$ axes); relative displacement of inner arm 12 and outer arm 13 to each other along the $Y_3$ axis, and handrail 50 dimensions ($X_2$, $Z_2$ axes). The handrail anchoring assembly 300 should be designed so that in handrail engaged configuration, the anchor locking angle would be preferably approximately 90 degrees, and the anchor release angle would be preferably in the range of 110-120 degrees, more preferably 113 degrees. As mentioned earlier, the outer arm 13 has a generally concave shape. Since this also affects the anchor release angle, design decisions would consider how closely one would want to adapt the concave shape to a particular handrail 50 shape, or provide for a more generic handrail shape.

Referring to FIGS. 5A-5B, the bottom surface of anchor body 11 is contacting the upper surface of handrail 50, with the inner surface of the inner arm 12 contacting the handrail 50 proximal surface, and the inner surface of the outer arm 13 contacting the handrail 50 distal surface at outermost tangent point and a portion of the lower surface of handrail 50. Referring to FIG. 5B, the outer arm 13 having a concave shape that contacts the handrail 50 lower surface and distal surface provides resistance to the handrail anchoring assembly 300 disengaging (positive $Z_2$ axis direction) from the handrail 50 when the anchor engaging angle is less than the anchor release angle. For anchor engaging angles less than the anchor release angle, the lower inner surface (distal to anchor body 11) of the outer arm 13 physically interferes with the lower surface and distal surface of the handrail 50 resisting disengagement. In addition, the lower inner surfaces (distal to anchor body 11) of the inner arm 12 and outer arm 13 present friction forces to the proximal and distal surfaces of the handrail 50 respectively.

Referring to FIGS. 5A-5B, when the anchor engaging angle is less than or equal to the anchor locking angle, the inner surfaces of inner arm 12 and outer arm 13 exert normal forces against the proximal and distal surfaces of handrail 50. The resultant frictional forces create resistance for the handrail anchoring assembly 300 to slide downward along the longitudinal axis ($Y_2$ axis) of the handrail 50 and the apparatus 1 rotating in the negative $Z_2$ axis direction.

Figure 7B:
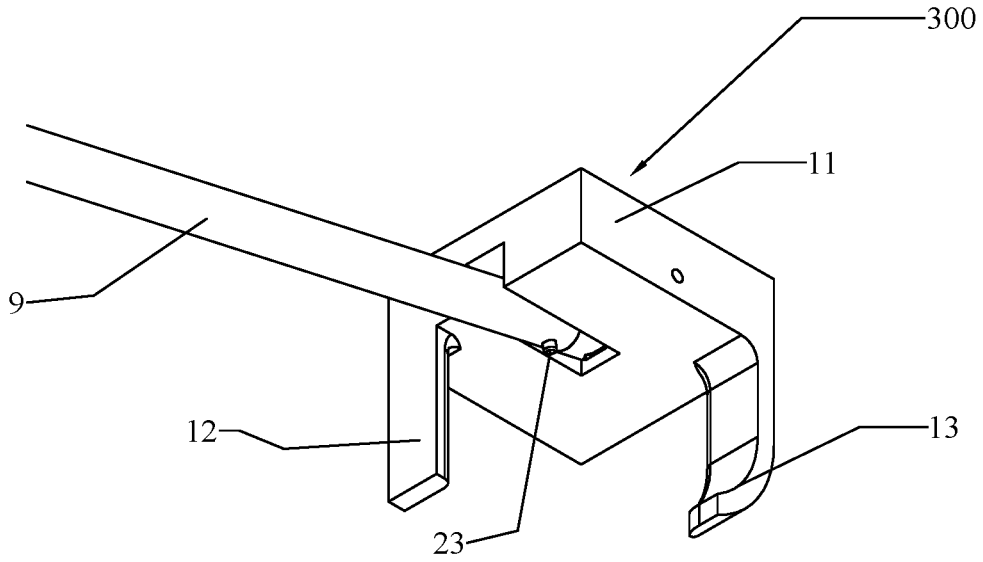
Figure 8A:
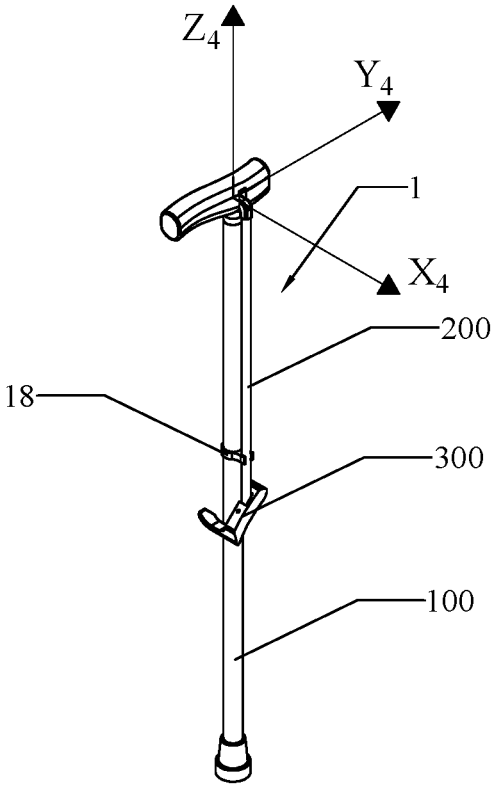
FIGS. 8A-8D illustrate various embodiments of the present invention, providing views of apparatus 1 in stowed configuration and handrail engaged configuration, for an embodiment where connecting assembly 200 and handrail anchoring assembly 300 are stowed external to weight support assembly 100.
Figure 8B:
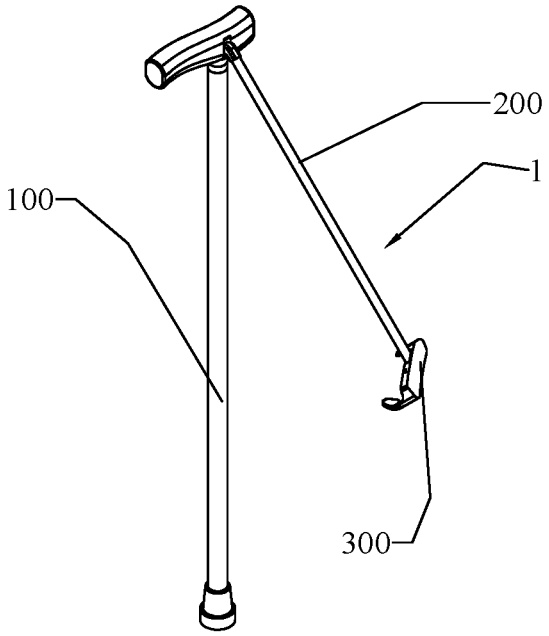
Figure 8C:
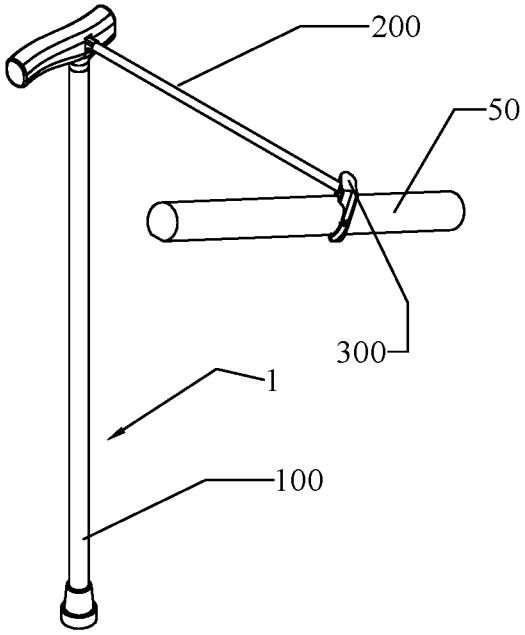
Figure 8D:
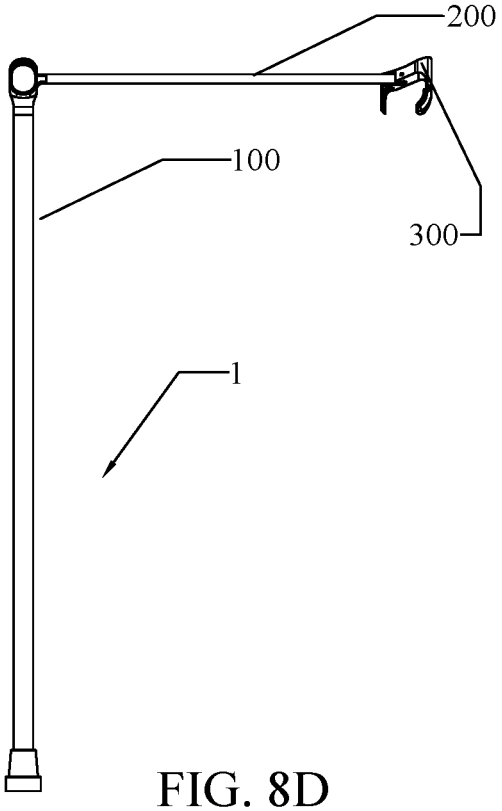

Referring to FIGS. 6, 7A-7B, and 8A-8D, in certain embodiments of the present invention, in the apparatus stowed configuration, the connecting assembly 200 and handrail anchoring assembly 300 are stowed external to weight support assembly 100, with connecting assembly 200 stowed preferably generally parallel to the weight support assembly 100. The connecting assembly 200 comprises: a crossbar member 9; a single axis of rotation ("SAR") connector 10, and a single axis of rotation ("SAR") connector 5. End B of SAR connector 10 is connected to the anchor body 11 with the SAR connector 10 axis of rotation being parallel to the $Y_3$ axis of anchor body 11, preferably located at the midpoint of the width (as measured in the $X_3$ dimension) of anchor body 11. End A of SAR connector 10 is connected to end B of crossbar member 9. Referring to FIG. 8A, which shows the XYZ coordinate axis 4 with $Z_4$ axis collinear with weight support member 2, crossbar member 9 end A is connected by single axis of rotation ("SAR") connector 5 to the weight support assembly 100, with the axis of rotation being perpendicular to the $Z_4$ axis. For handle 15 embodiments where dimensions in the $X_4$ and $Y_4$ axis directions are not equal, the axis of rotation would be parallel to the axis ($X_4$ or $Y_4$) for which the handle 15 dimension is greater. In FIGS. 8A-8D, the SAR connector 5 is shown as being connected at a location on the handle 15, but alternatively may be connected to a location on the weight support member 2. Connecting assembly 200 further comprises a bearing member to enable rotation of crossbar member 9 around its longitudinal axis. Referring to FIG. 6, this bearing member may be bearing member 7 interposed between SAR connector 5 and crossbar member 9, or bearing member 8 interposed between crossbar member 9 and SAR connector 10. Referring to FIGS. 8A-8D, various views are shown of the apparatus moving from stowed configuration (FIG. 8A), partially unstowed (FIG. 8B), handrail engaged configuration with handrail 50 shown (FIG. 8C), and handrail engaged configuration without handrail 50 shown (FIG. 8D).

Figure 9A:
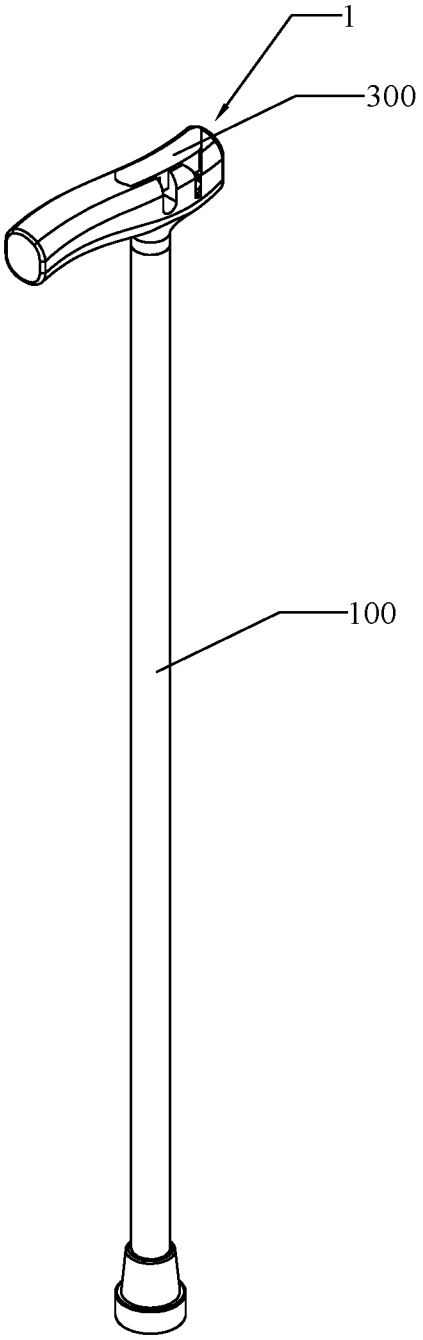
FIGS. 9A-9I illustrate various embodiments of the present invention, providing views of apparatus 1 in stowed configuration and handrail engaged configuration, for an embodiment where connecting assembly 200 and handrail anchoring assembly 300 are stowed internal to weight support assembly 100.
Figure 9B:
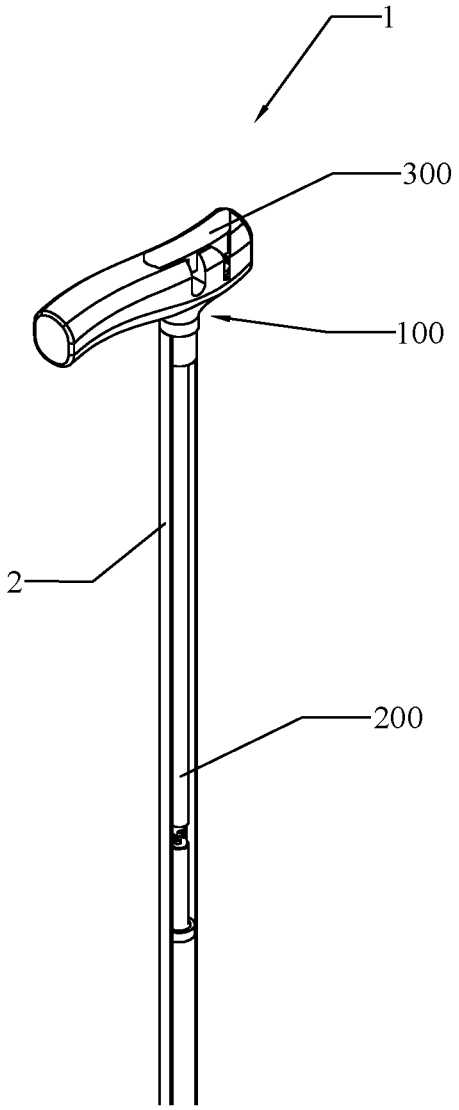
Figure 9C:
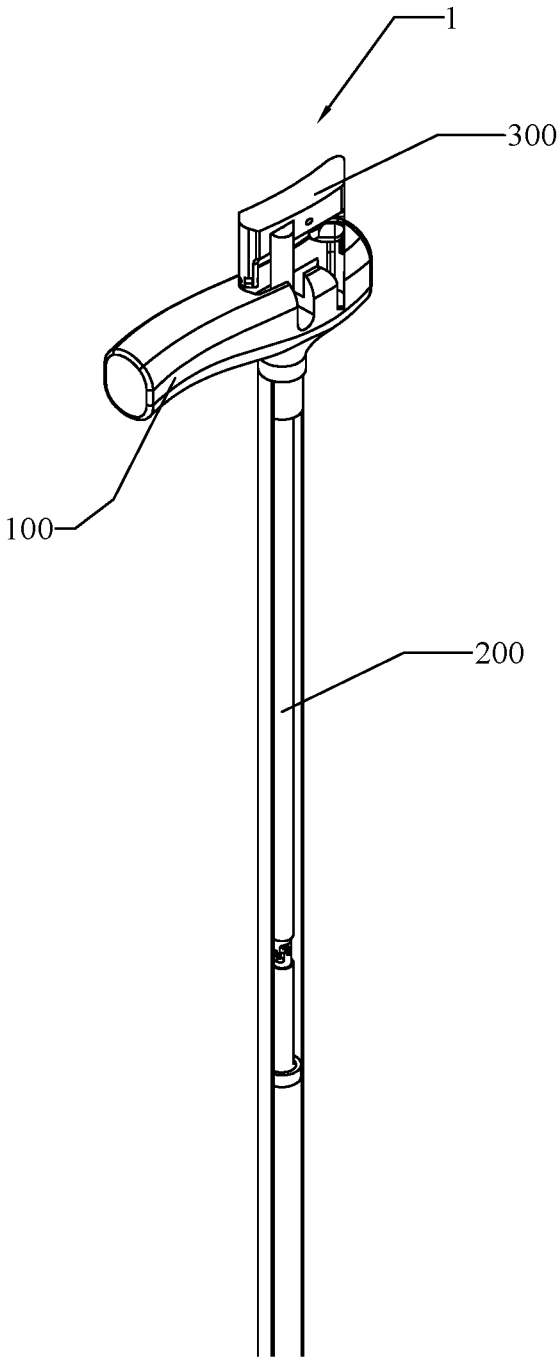
Figure 9D:
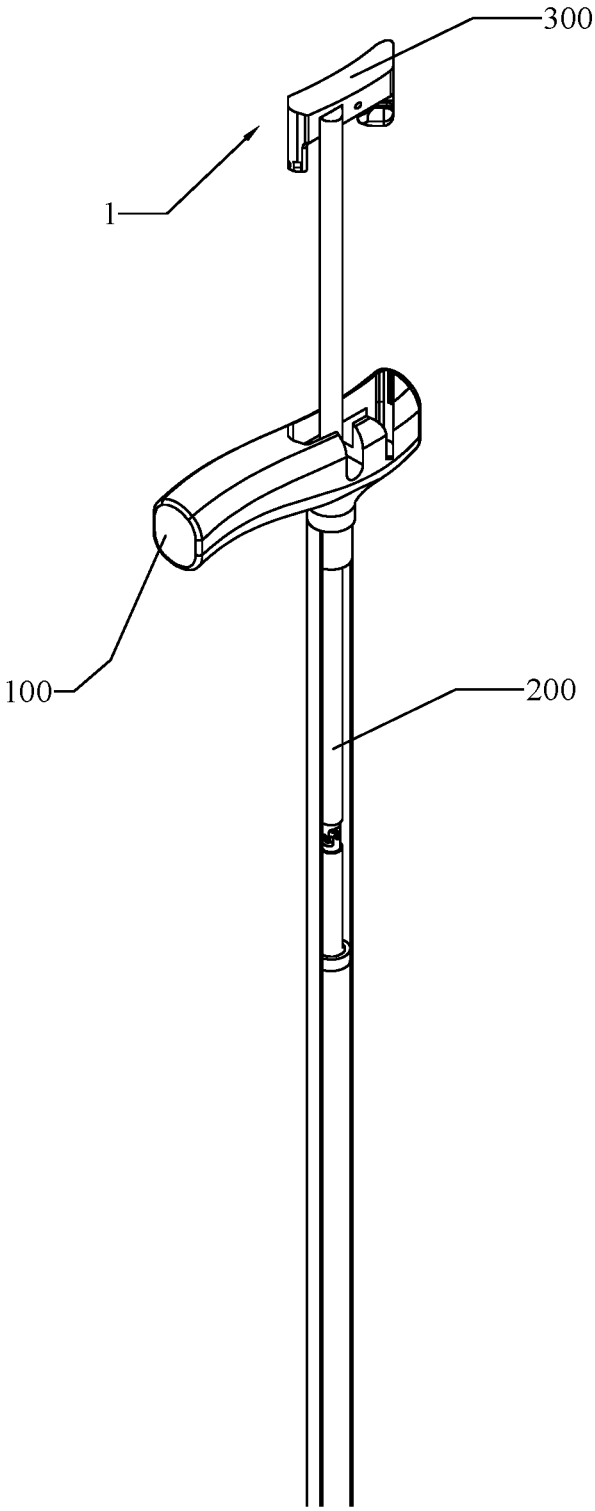
Figure 9E:
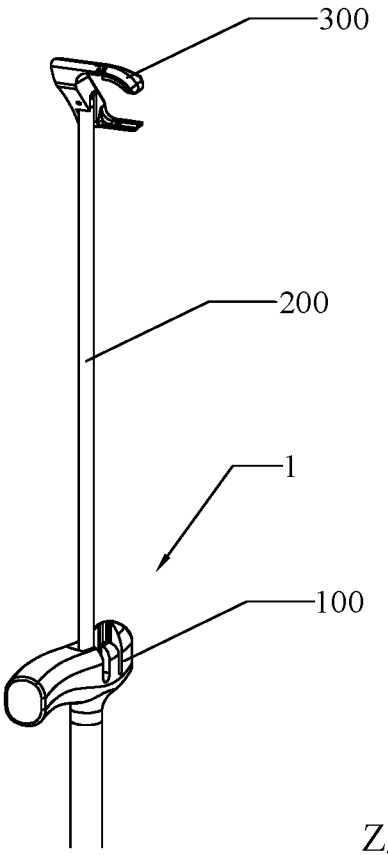
Figure 9F:
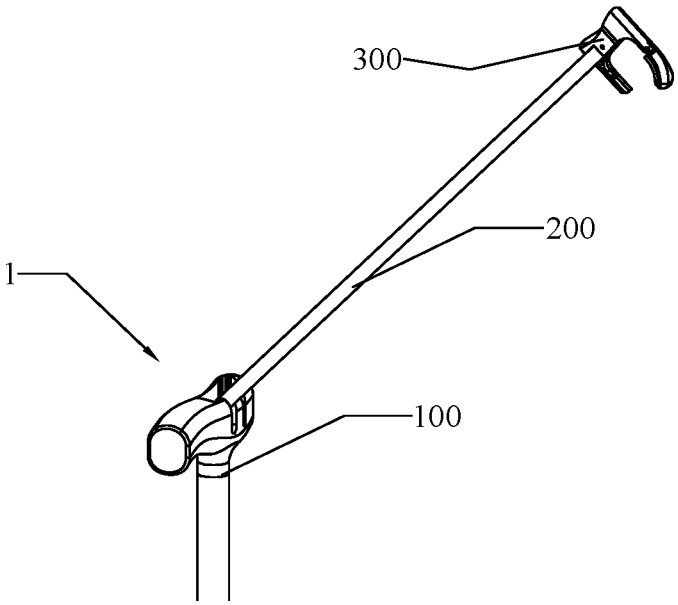
Figure 9G:
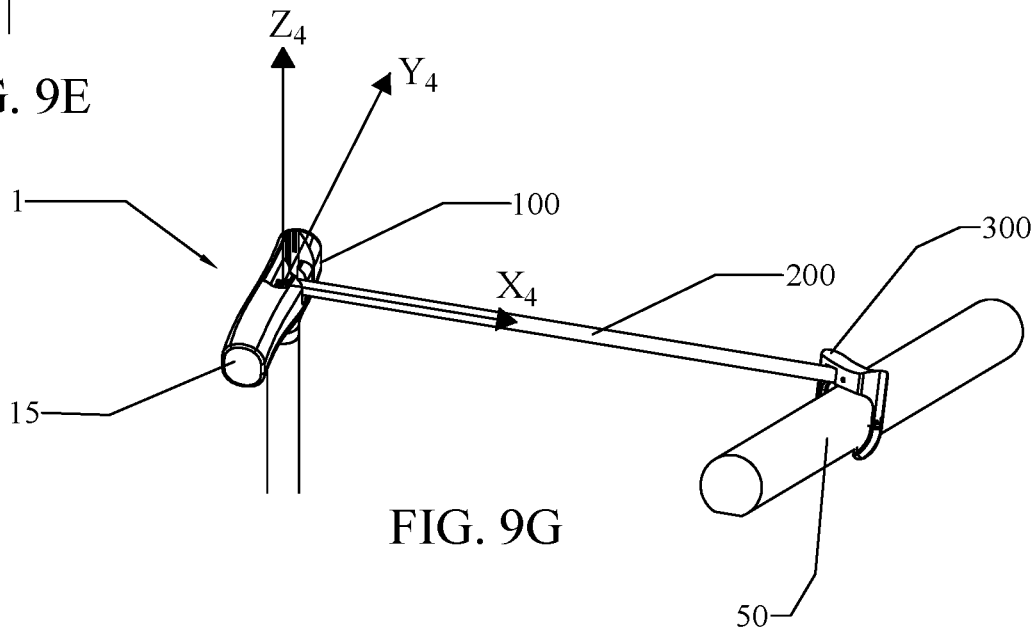
Figure 9H:
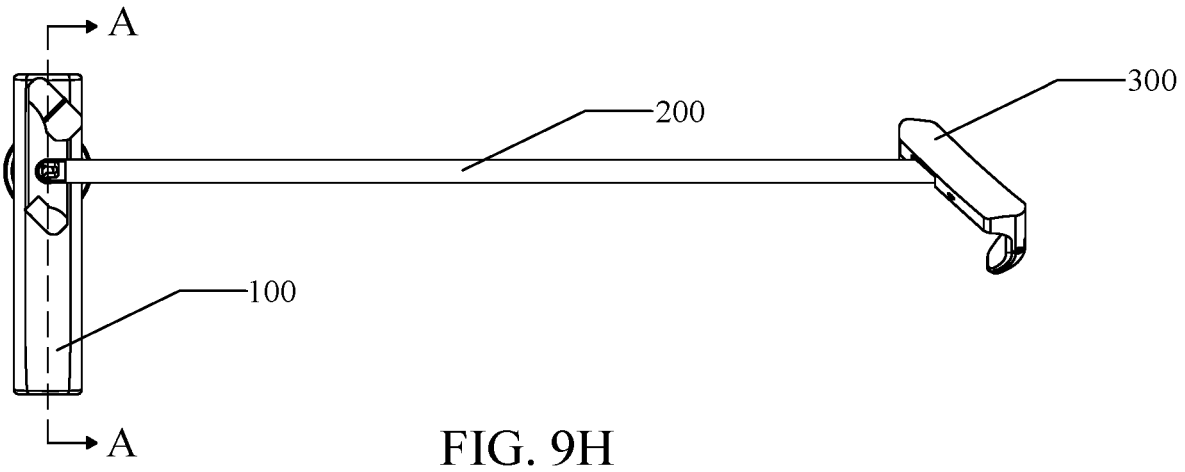
Figure 9I:
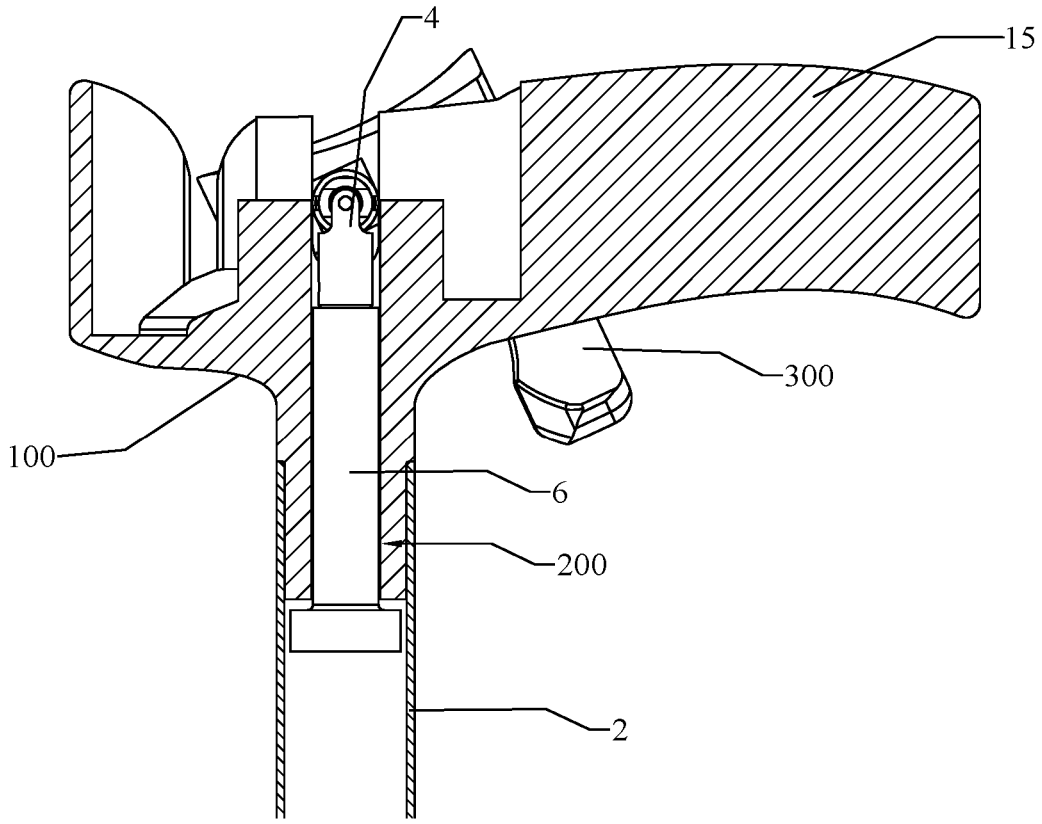
Figure 10:
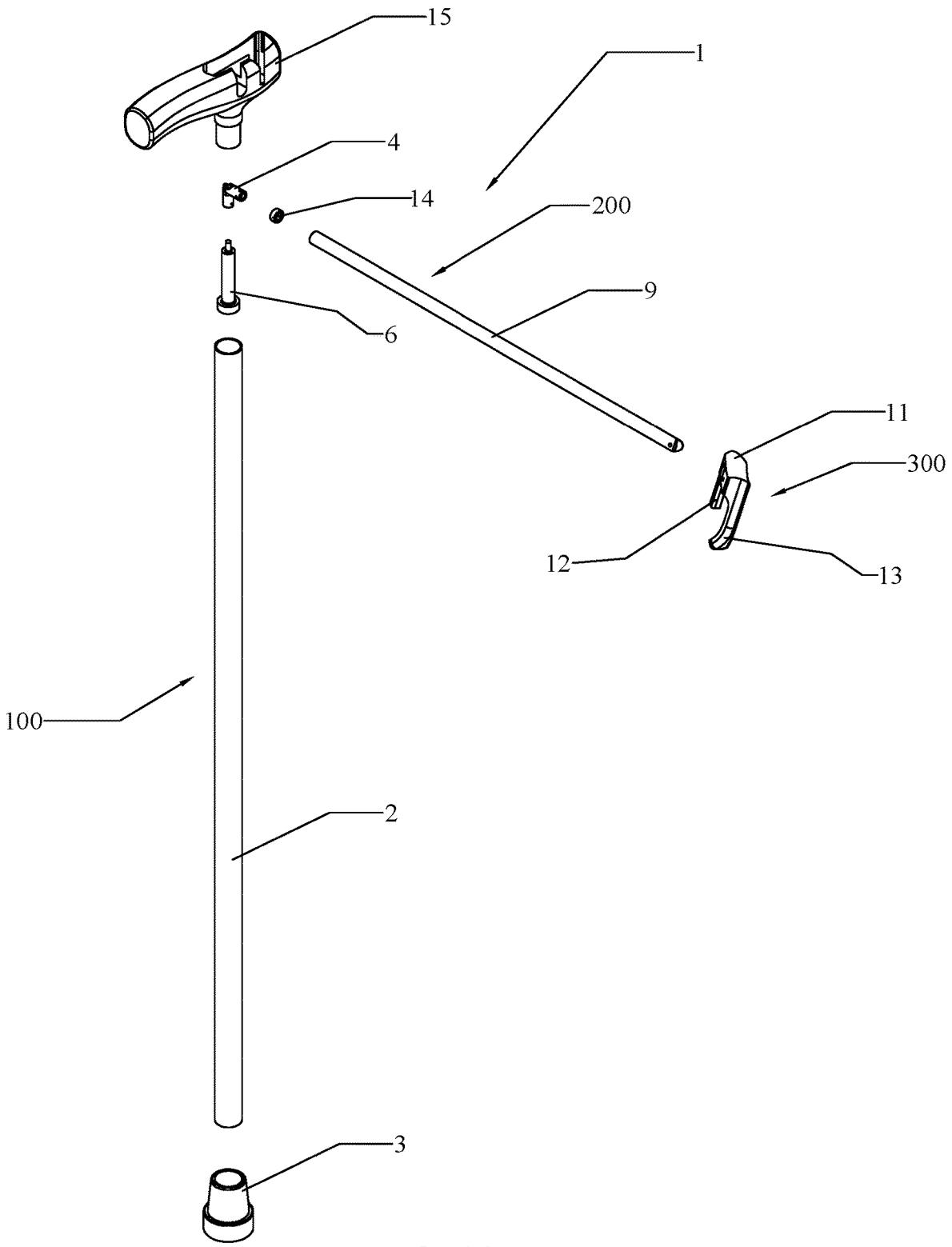
FIG. 10 illustrates various embodiments of the present invention, providing a perspective exploded view of an embodiment where the connecting assembly 200 and handrail anchoring assembly 300 are stowed internal to the weight support assembly 100.
Figure 11A:
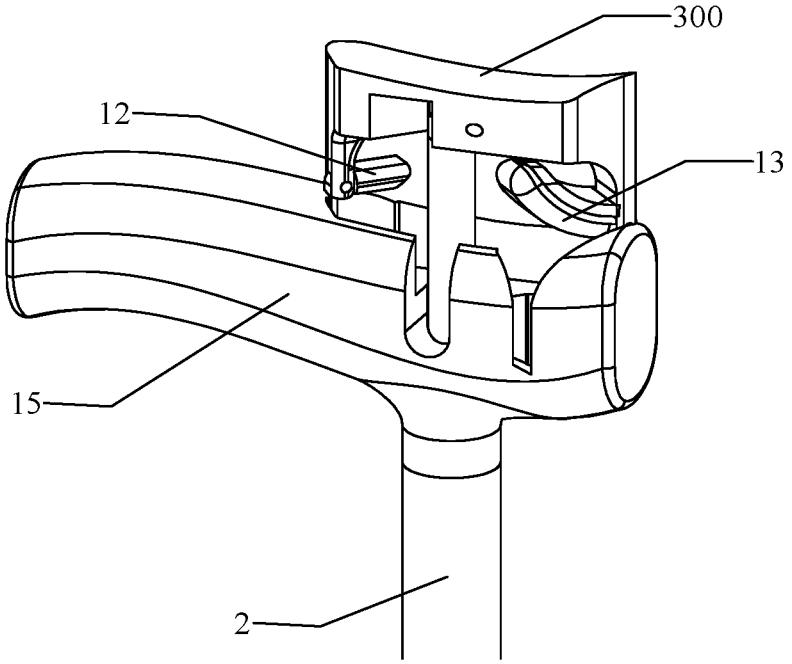
FIGS. 11A-11B illustrate various embodiments of the present invention, for an embodiment where the connecting assembly 200 and handrail anchoring assembly 300 are stowed internal to the weight support assembly 100, providing perspective views of the handrail anchoring assembly 300 and handle 15, where inner arm 12 and outer arm 13 are hinged, allowing them to fold, for easier storage of handrail anchoring assembly 300 in handle 15.
Figure 11B:
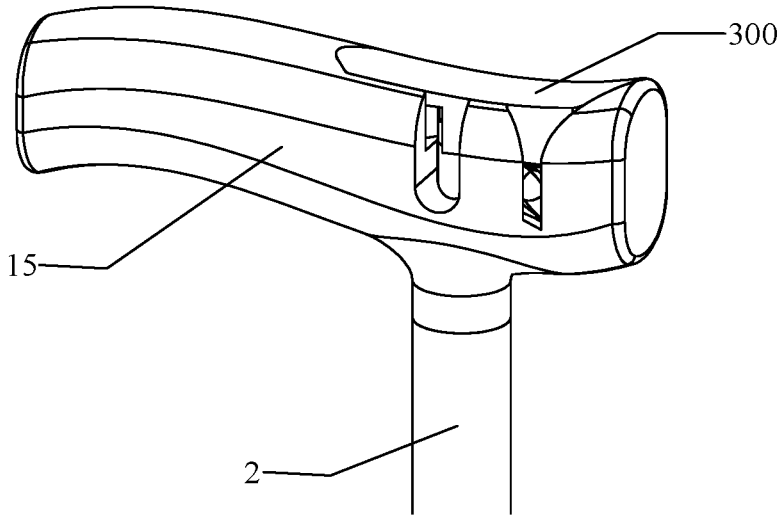

Referring to FIG. 9A, in certain embodiments of the present invention, in the stowed configuration, the connecting assembly 200 is stowed within the weight support assembly 100, and the handrail anchoring assembly 300 is stowed within the handle 15 of the weight support assembly 100. FIG. 9B shows a cutaway view of a portion of weight support member 2 to reveal connecting assembly 200 disposed within weight support member 2. FIGS. 9C-9I present views of connecting assembly 200 and handrail anchoring assembly 300 being withdrawn from weight support assembly 100, to transition the apparatus 1 from stowed configuration to handrail engaged configuration. FIGS. 9C-9D present views of connecting assembly 200 and handrail anchoring assembly 300 being partially withdrawn from weight support assembly 100. Referring to FIG. 9E, connecting assembly 200 and handrail anchoring assembly 300 are withdrawn from weight support assembly 100 to the fullest extent. Referring to FIG. 9F, connecting assembly 200 and handrail anchoring assembly 300 are fully withdrawn from weight support assembly 100 but not fully deployed to the handrail engaged configuration. Referring to FIG. 9G, the apparatus 1 is in handrail engaged configuration with handrail 50 shown. Referring to FIGS. 9A-9I, 10, and 11A-11B, weight support member 2 is hollow during at least a portion of its length, so as to receive connecting assembly 200 therein. Connecting assembly 200 has outer diameter less than the inner diameter of weight support member 2. The connecting assembly 200 comprises: a crossbar member 9, a bearing member 14, a single axis of rotation ("SAR") connector 4, and a stopper member 6. End B of crossbar member 9 has a pivot connection to the anchor body 11 with its axis of rotation being parallel to the $Y_3$ axis of anchor body 11, with the pivot connection preferably located at the midpoint of the width (as measured in the $X_3$ dimension) of anchor body 11. End B of SAR connector 4 is connected to end A of crossbar member 9 with bearing member 14 interposed between crossbar member 9 and SAR connector 4 to enable rotation of crossbar member 9 around its longitudinal axis. End A of stopper member 6 has a diameter larger than end B. End A of SAR connector 4 is connected to end B of stopper member 6. Referring to FIGS. 9H-9I, handle 15 has an interior passage through which connecting assembly 200 passes when apparatus 1 is making the transition between stowed and handrail engaged configurations. Connecting assembly 200 has diameter less than the interior passage diameter except for end A of stopper member 6 which is larger than the diameter of the interior passage to prevent the connecting assembly 200 from being completely withdrawn from weight support assembly 100. Handle 15 has a channel that allows for connecting assembly 200 to be deployed at an approximately 90 degree angle relative to weight support assembly 100, when apparatus 1 is in the handrail engaged configuration. For handle 15 embodiments where dimensions in the $X_4$ and $Y_4$ axis directions are not equal, handle 15 would have a channel (see FIGS. 9D-9G) to enable connecting assembly 200 to be deployed at an approximately 90 degree angle relative to the axis ($X_4$ or $Y_4$) for which the handle dimension is greater, when apparatus 1 is in the handrail engaged configuration. In various embodiments, handle 15 contains recesses to receive handrail anchoring assembly 300 therein when apparatus 1 is in the stowed configuration. Referring to FIGS. 11A-11B, in various embodiments, inner arm 12 and outer arm 13 are joined to the lower surface of anchor body 11 by hinged connections, enabling them to fold when stowed in handle 15.

Referring to FIGS. 4A-4E, to descend a stairway 60, the user would engage the handrail anchoring assembly 300 with the handrail 50. Grasping the handrail 50 with the hand ("handrail hand") proximal to the handrail, the user would use their other hand ("handle hand") to grasp weight support assembly 100 to lift and rotate the apparatus 1 in the positive direction around the $Z_2$ axis sufficiently to ensure that the anchor engaging angle is greater than the anchor locking angle but less than the anchor release angle. Maintaining a grasp of the handrail 50 with their handrail hand, the user uses their handle hand to exert a force on weight support assembly 100 so that apparatus 1 translates in the positive $Y_2$ direction until the handrail anchoring assembly 300 (still on the handrail) is located over the step below. The user may use their handrail hand to assist the handrail anchoring assembly 300 in sliding downward along handrail 50 (positive $Y_2$ axis direction). Maintaining their grasp of the handrail 50 with their handrail hand, the user would use their handle hand (still grasping weight support assembly 100) to rotate the apparatus 1 in the negative direction around the $Z_2$ axis sufficiently to ensure that the anchor engaging angle is less than or equal to the anchor locking angle. This is to provide resistance for the handrail anchor assembly 300 disengaging from the handrail 50, sliding further downward along the longitudinal axis of the handrail 50, or the apparatus 1 rotating in the negative $Z_2$ axis direction while the user is stepping down to the step below. The user would then plant the weight support assembly 100 on the tread of the step below. The user steps down to the step below, grasping the handle 15 of the weight support assembly 100 with their handle hand for weight support and continuing to grasp the handrail 50 with their handrail hand. In stepping down to the step below, the user relies upon the weight support assembly 100 to help support their weight and for stability, while grasping the handrail 50 for balance and support. When the user is ready to step down to the next step below, the user would repeat the process.

Figure 12A:
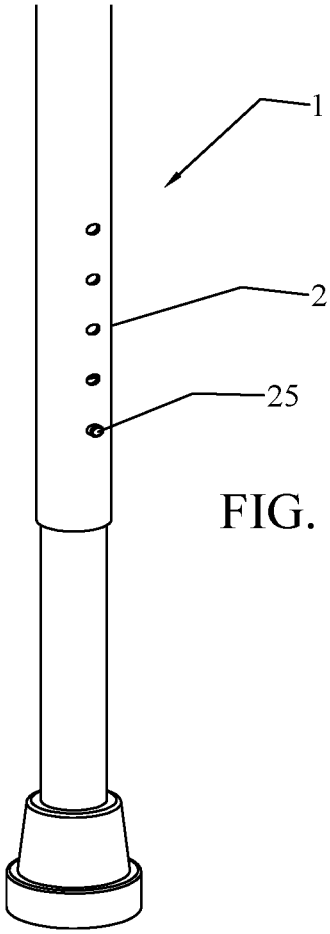
FIGS. 12A and 12B illustrate various embodiments of the present invention, wherein the lengths of weight support member 2 (FIG. 12A) and crossbar member 9 (FIG. 12B) are adjustable.
Figure 12B:
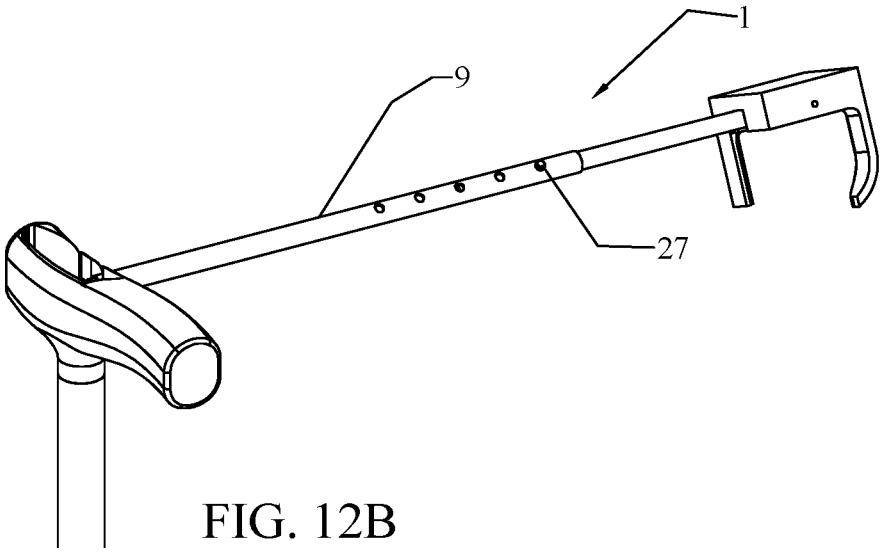

In various embodiments (FIGS. 2, 3, 4A-4E, 5A-5H, 6, 7A-7B, 8A-8D, 9A-9I, 10, 11A-11B, and 12B), apparatus 1 is adapted for use with a handrail 50 on the right hand side while descending the stairway 60. In various embodiments (not shown), apparatus 1 is adapted for use with a handrail 50 on the left hand side while descending a stairway. It would be obvious to someone skilled in the art to create the needed mirror image components of the apparatus for this purpose. In various embodiments, in the stowed configuration, the connecting assembly 200 is disposed in a position generally parallel to the weight support assembly 100 and attached via means selected from the list consisting of one or more clips 18 (FIG. 8A), straps (not shown), and combination of the foregoing. In various embodiments, the handrail anchoring assembly 300 is adjustable for engagement with various handrail 50 thicknesses ($Z_2$ dimension), shapes, and widths ($X_2$ dimension). Referring to FIG. 7B, in various embodiments, the handrail anchoring assembly 300 is removable by the user via a mechanism such as pressing a spring loaded pin 23, allowing one to attach a handrail anchoring assembly 300 that has been adapted for a particular handrail 50 shape, thickness, width, or combination of the foregoing. Referring to FIG. 12A, in various embodiments, weight support member 2 is comprised of telescoping legs allowing for adjusting the length of weight support member 2, with the length secured in place by means selected from the list of: a) a spring loaded pin 25 to engage with perforations at pre-determined longitudinal locations, b) position locking knobs or latches (not shown), c) combination of the foregoing. Referring to FIG. 12B, in various embodiments, crossbar member 9 is comprised of telescoping legs allowing for adjusting the length of crossbar member 9, with the length secured in place by means selected from the list of: a) a spring loaded pin 27 to engage with perforations at pre-determined longitudinal locations, b) position locking knobs or latches (not shown), c) combination of the foregoing.

Example 1

Referring to FIGS. 2, 3, 4A-4E, 9A-9I, 10, and 11A-11B, a conventional cane was adapted to serve as weight support assembly 100, adapted to receive connecting assembly 200, for an embodiment where connecting assembly 200 is stowed internal to weight assembly 100. Handrail anchoring assembly 300 was designed to engage with a handrail of diameter 2 inches, with anchor release angle=113 degrees and anchor locking angle=90 degrees. Handrail assembly 300 was designed with inner arm 12 and outer arm 13 having hinged connections with anchor body 11, enabling handrail anchoring assembly 300 to be fully received in handle 15 when in the stowed configuration.

Obviously numerous modifications and variations of the present invention are possible in the light of the above teachings. It is therefore to be understood that within the scope of the appended claims the invention may be practiced otherwise than as specifically described therein.

What is claimed is:

1. A portable walking aid apparatus that assists a user with safer descent of a stairway having at least one handrail, said apparatus comprising:

a weight support assembly comprising:

a handle, a portion of which is grasped by said user, a weight support member having ends A and B, with said handle connected to end A of said weight support member, and with end B of said weight support member intended to be placed on the tread of each step of said stairway as said user descends said stairway;

a connecting assembly, comprising:

a crossbar member having ends A and B, a first single axis of rotation ("SAR") connector having ends A and B, end A of said first SAR connector being connected to said handle, end B of said first SAR connector being connected to end A of said crossbar member, a second SAR connector having ends A and B, end A of said second SAR connector being connected to end B of said crossbar member, a bearing member enabling rotation of said crossbar member around its longitudinal axis, having a position selected from the list consisting of 1) interposed between end B of said first SAR connector and end A of said crossbar member, 2) interposed between end B of said crossbar member and end A of said second SAR connector, a handrail anchoring assembly, comprising:

an anchor body having a lower surface, an end proximal to said user ("proximal end") and an end distal to said user ("distal end"), with end B of said second SAR connector being pivotally connected to said anchor body proximal end, with the axis of rotation of said pivot connection being at a right angle to the longitudinal axis of said crossbar member, an inner arm projecting downward from said anchor body lower surface at said anchor body proximal end, having a generally flat shape, an outer arm projecting downward from said anchor body lower surface at said anchor body distal end, having a generally concave shape, with said inner arm and said outer arm having opposing inner surfaces, and with said inner arm forward of said outer arm with respect to the downward direction along said handrail;

wherein said apparatus has two configurations:

a stowed configuration and a handrail engaged configuration;

wherein in said stowed configuration, said connecting assembly is disposed in a position generally parallel to said weight support assembly;

and wherein in said handrail engaged configuration: said connecting assembly is disposed at an approximate 90 degree angle with respect to said weight support assembly, said handrail anchoring assembly is engaged with said handrail, said handrail having upper and lower surfaces, a surface proximal to said user ("proximal surface") and a surface distal to said user ("distal surface"), said anchor body lower surface is in contact with said handrail upper surface, said crossbar member and said handrail form an anchor engaging angle disposed therebetween, said handrail anchoring assembly is resistant to sliding in the downward direction along said handrail when said anchor engaging angle is less than or equal to an anchor locking angle, due to a torque generated by said crossbar resulting in a frictional force applied by said inner arm inner surface to said handrail proximal surface and a frictional force applied by said outer arm inner surface to said handrail distal surface, said handrail anchoring assembly is able to slide in the downward direction along said handrail but resistant to being disengaged from said handrail when said anchor engaging angle is greater than said anchor locking angle, but less than or equal to an anchor release angle, with said anchor release angle being the minimum angle at which the lower inner surfaces (distal to said anchor body) of said inner arm and said outer arm would apply frictional forces to said handrail proximal and distal surfaces respectively, and said outer arm lower inner surface (distal to said anchor body) physically interferes with the lower and distal surfaces of said handrail, and said handrail anchoring assembly is able to slide in the downward direction along said handrail and able to be disengaged from said handrail when said anchor engaging angle is greater than said anchor locking angle and greater than said anchor release angle.

2. The apparatus according to claim 1 further comprising:

attachment means for said connecting assembly to be attached to said weight support assembly when said apparatus is in said stowed configuration, wherein said attachment means is selected from the list consisting of: one or more straps, one or more clips, and any combination of the foregoing.

3. The apparatus according to claim 1, wherein:

said handrail anchoring assembly is detachable from said connecting assembly, allowing said user to attach a handrail anchoring assembly that is specifically adapted for a handrail parameter, said parameter being selected from the list consisting of: shape, width, thickness, and any combination of the foregoing.

4. The apparatus according to claim 1 further comprising:

resilient high coefficient of friction material being disposed on a location selected from the list consisting of: a) the inner surface of said inner arm, b) the inner surface of said outer arm, and c) the inner surfaces of said inner arm and said outer arm.

5. The apparatus according to claim 1, wherein:

said weight support member is comprised of two or more telescoping members, and further comprising:

means for securing the relative positions of said telescoping members to each other by means selected from the list consisting of: a) a spring loaded pin to engage with perforations at pre-determined longitudinal locations, b) position locking knobs or latches, and c) combination of the foregoing.

6. The apparatus according to claim 1, wherein:

said crossbar member is comprised of two or more telescoping members, and further comprising:

means for securing the relative positions of said telescoping members to each other by means selected from the list consisting of: a) a spring loaded pin to engage with perforations at pre-determined longitudinal locations, b) position locking knobs or latches, and c) combination of the foregoing.

7. The apparatus according to claim 1, further comprising:

a cap disposed on end B of said weight support member, wherein said cap is composed of a resilient non-skid material.

8. The apparatus according to claim 1, wherein:

end B of said weight support member is closed.

9. The apparatus according to claim 1, wherein:

said handrail has a cross-sectional shape selected from the list consisting of: round, oval, square, rectangular, and any combination of the foregoing.

10. The apparatus according to claim 1, wherein:

said apparatus is a mobility aid selected from the group consisting of: a) a cane, b) a walking stick, and c) a crutch.

11. A portable walking aid apparatus that assists a user with safer descent of a stairway having at least one handrail, said apparatus comprising:

a weight support assembly comprising:

a handle, a portion of which is grasped by said user, a weight support member having ends A and B, wherein said weight support member is hollow during at least a portion of its length, with said handle connected to end A of said weight support member, and with end B of said weight support member intended to be placed on the tread of each step of said stairway as said user descends said stairway;

a connecting assembly having an outer diameter less than the inner diameter of said weight support member, comprising:

a stopper member having ends A and B, with end A of said stopper member having a larger diameter than end B of said stopper member, a single axis of rotation ("SAR") connector having ends A and B, with end A of said SAR connector being connected to end B of said stopper member, a crossbar member having ends A and B, with end B of said SAR connector being connected to end A of said crossbar member, a bearing member enabling rotation of said crossbar member around its longitudinal axis, having a position interposed between said SAR connector and said crossbar member, wherein said handle has an internal channel of diameter greater than the diameters of all of said connector assembly members except for end A of said stopper member;

a handrail anchoring assembly, comprising:

an anchor body having a lower surface, an end proximal to said user ("proximal end") and an end distal to said user ("distal end"), with end B of said crossbar member being pivotally connected to said anchor body proximal end, with the axis of rotation of said pivot connection being at a right angle to the longitudinal axis of said crossbar member, an inner arm projecting downward from said anchor body lower surface at said anchor body proximal end, having a generally flat shape, an outer arm projecting downward from said anchor body lower surface at said anchor body distal end, having a generally concave shape, with said inner arm and said outer arm having opposing inner surfaces, and with said inner arm forward of said outer arm with respect to the downward direction along said handrail;

wherein said apparatus has two configurations:

a stowed configuration and a handrail engaged configuration;

wherein in said stowed configuration, said connecting assembly is disposed within said weight support member, and said handrail anchoring assembly is disposed within said handle;

and wherein in said handrail engaged configuration:

said connecting assembly is external to and disposed at an approximate 90 degree angle with respect to said weight support assembly, said handrail anchoring assembly is engaged with said handrail, said handrail having upper and lower surfaces, a surface proximal to said user ("proximal surface") and a surface distal to said user ("distal surface"), said anchor body lower surface is in contact with said handrail upper surface, said crossbar member and said handrail longitudinal axis form an anchor engaging angle disposed therebetween, said handrail anchoring assembly is resistant to sliding in the downward direction along said handrail when said anchor engaging angle is less than or equal to an anchor locking angle, due to a torque generated by said crossbar resulting in a frictional force applied by said inner arm inner surface to said handrail proximal surface and a frictional force applied by said outer arm inner surface to said handrail distal surface, said handrail anchoring assembly is able to slide in the downward direction along said handrail but resistant to being disengaged from said handrail when said anchor engaging angle is greater than said anchor locking angle, but less than or equal to an anchor release angle, with said anchor release angle being the minimum angle at which the lower inner surfaces (distal to said anchor body) of said inner arm and said outer arm would apply frictional forces to said handrail proximal and distal surfaces respectively, and said outer arm lower inner surface (distal to said anchor body) physically interferes with the lower and distal surfaces of said handrail, and said handrail anchoring assembly is able to slide in the downward direction along said handrail and able to be disengaged from said handrail when said anchor engaging angle is greater than said anchor locking angle and greater than said anchor release angle.

12. The apparatus according to claim 11, wherein:

said handle has a recess to receive said handrail anchoring assembly therein when said apparatus is in said stowed configuration.

13. The apparatus according to claim 12, wherein:

said inner arm and said outer arm are pivotally connected to said anchor body, allowing said inner arm and said outer arm to be folded prior to said handrail anchoring assembly being received in said handle.

14. The apparatus according to claim 11, wherein:

said handrail anchoring assembly is detachable from said connecting assembly, allowing said user to attach a handrail anchoring assembly that is specifically adapted for a handrail parameter, said parameter being selected from the list consisting of: shape, width, thickness, and combination of the foregoing.

15. The apparatus according to claim 11 further comprising:

resilient high coefficient of friction material being disposed on a location selected from the list consisting of: a) the inner surface of said inner arm, b) the inner surface of said outer arm, and c) the inner surfaces of said inner arm and said outer arm.

16. The apparatus according to claim 11, wherein:

said weight support member is comprised of two or more telescoping members, and further comprising:

means for securing the relative positions of said telescoping members to each other by means selected from the list consisting of: a) a spring loaded pin to engage with perforations at pre-determined longitudinal locations, b) position locking knobs or latches, and c) combination of the foregoing.

17. The apparatus according to claim 11, wherein:

said crossbar member is comprised of two or more telescoping members, and further comprising:

means for securing the relative positions of said telescoping members to each other by means selected from the list consisting of: a) a spring loaded pin to engage with perforations at pre-determined longitudinal locations, b) position locking knobs or latches, and c) combination of the foregoing.

18. The apparatus according to claim 11, further comprising:

a cap disposed on end B of said weight support member, wherein said cap is composed of a resilient non-skid material.

19. The apparatus according to claim 11, wherein:

end B of said weight support member is closed.

20. The apparatus according to claim 11, wherein:

said handrail has a cross-sectional shape selected from the list consisting of: round, oval, square, rectangular, and any combination of the foregoing.

21. The apparatus according to claim 11, wherein:

said apparatus is a mobility aid selected from the group consisting of: a) a cane, b) a walking stick, and c) a crutch.

* * * * *